US012043502B2

(12) United States Patent
Hayasaka et al.

(10) Patent No.: US 12,043,502 B2
(45) Date of Patent: Jul. 23, 2024

(54) LOADING MECHANISM, FEEDING DEVICE, IMAGE FORMING APPARATUS, AND IMAGE FORMING SYSTEM

(71) Applicants: Kenji Hayasaka, Kanagawa (JP); Takashi Fukumoto, Kanagawa (JP)

(72) Inventors: Kenji Hayasaka, Kanagawa (JP); Takashi Fukumoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 691 days.

(21) Appl. No.: 17/206,467

(22) Filed: Mar. 19, 2021

(65) Prior Publication Data

US 2021/0292115 A1 Sep. 23, 2021

(30) Foreign Application Priority Data

Mar. 23, 2020 (JP) ..... 2020-051366

(51) Int. Cl.
*B65H 1/14* (2006.01)
*B65H 1/04* (2006.01)
*B65H 3/12* (2006.01)

(52) U.S. Cl.
CPC ..... *B65H 1/14* (2013.01); *B65H 1/04* (2013.01); *B65H 3/128* (2013.01)

(58) Field of Classification Search
CPC ..... B65H 1/14; B65H 1/04; B65H 3/128
USPC ..... 271/148
See application file for complete search history.

(56) References Cited

U.S. PATENT DOCUMENTS 3,567,216 A * 3/1971 Zeller ..... B65H 1/08 271/148
4,593,895 A * 6/1986 Myers ..... B65H 1/266 414/788.2
5,364,087 A * 11/1994 Schieck ..... B65H 1/04 271/160
6,065,745 A * 5/2000 Casper ..... B65H 1/12 271/22
6,283,469 B1 * 9/2001 Weber ..... B65H 1/14 271/160
7,458,574 B2 * 12/2008 Wilcox ..... B65H 1/14 271/148

(Continued)

FOREIGN PATENT DOCUMENTS

JP 2016-088682 5/2016
JP 2018-203536 12/2018
JP 2020-055662 4/2020

OTHER PUBLICATIONS

U.S. Appl. No. 16/584,043, filed Sep. 26, 2019.

*Primary Examiner* — Patrick H Mackey
(74) *Attorney, Agent, or Firm* — Harness, Dickey & Pierce, P.L.C.

(57) ABSTRACT

Disclosed is a loading unit for use in loading a bundle of objects to be conveyed, the loading unit being installed on a lifting member of a feeding device. The loading unit includes a first movable base on which a downstream side in a conveying direction of a bundle of objects to be conveyed is loaded, the first movable base being rotatable; and a second movable base on which an upstream side in the conveying direction of the bundle of objects is loaded, the second movable base being rotatable and disposed on a more upstream side in the conveying direction than the first movable base.

20 Claims, 30 Drawing Sheets

(56) References Cited

U.S. PATENT DOCUMENTS

| | | | | |
|---|---|---|---|---|
| 7,686,294 | B2 * | 3/2010 | Moore | B65H 1/18 271/148 |
| 8,177,223 | B2 * | 5/2012 | Bauer | B65H 1/14 271/145 |
| 8,480,073 | B1 * | 7/2013 | Ishikawa | B65H 3/18 271/18.2 |
| 8,827,262 | B2 * | 9/2014 | Itabashi | B65H 1/266 271/148 |
| 9,272,857 | B2 * | 3/2016 | Nakagawa | B65H 1/14 |
| 9,487,370 | B2 | 11/2016 | Utagawa et al. | |
| 10,494,207 | B2 * | 12/2019 | Niikura | B65H 1/04 |
| 2016/0122144 | A1 | 5/2016 | Fukumoto et al. | |
| 2020/0102166 | A1 | 4/2020 | Hayasaka et al. | |

* cited by examiner

LOADING MECHANISM, FEEDING DEVICE, IMAGE FORMING APPARATUS, AND IMAGE FORMING SYSTEM

CROSS-REFERENCE TO RELATED APPLICATION

The present application is based on and claims priority under 35 U.S.C. § 119 to Japanese Patent Application No. 2020-051366, filed on Mar. 23, 2020, the content of which is incorporated herein by reference in its entirety.

BACKGROUND OF THE INVENTION

1. Field of the Invention

The disclosure discussed herein relates to a loading unit, a feeding device, an image forming apparatus, and an image forming system.

2. Description of the Related Art

A loading unit detachably installed on a lifting member of a feeding device is known in the art for use in loading a bundle of objects to be conveyed.

Patent Document 1, for example, discloses such a loading unit installed on a bottom plate serving as a lifting member, on which a bundle of objects to be conveyed such as a bundle of envelops is loaded. This loading unit includes an auxiliary tray and a tilting table. The auxiliary tray is a non-rotatable fixed tray on which a thick bottom side of a bundle of envelopes at a downstream in a conveying direction is loaded. The tilting table is a rotatably movable base on which a thin opening side of the bundle of envelopes at an upstream in the conveying direction is loaded. The tilting table is disposed at a more upstream side than the auxiliary tray in the conveying direction. The tilting table is inclined such that an upstream side is positioned higher than a downstream side in the conveying direction when the bottom plate is located at a lowered position, and the upstream side in the conveying direction is lowered as the bottom plate rises. According to this configuration, the difference in height between the upstream side and the downstream side in the conveying direction of a top surface of the bundle of envelopes can be reduced when the number of the envelopes of the bundle is reduced.

However, when an end of the bundle of objects to be conveyed is thicker than the center of the bundle of objects, the bundle of objects will not be efficiently fed.

RELATED ART DOCUMENT

Patent Document

[Patent Document 1] Japanese Unexamined Patent Application Publication No. 2018-203536

SUMMARY OF THE INVENTION

According to one aspect of the present invention, a loading unit for use in loading a bundle of objects to be conveyed is provided, the loading unit being installed on a lifting member of a feeding device. The loading unit includes a first movable base on which a downstream side in a conveying direction of a bundle of objects to be conveyed is loaded, the first movable base being rotatable; and a second movable base on which an upstream side in the conveying direction of the bundle of objects is loaded, the second movable base being rotatable and disposed on a more upstream side in the conveying direction than the first movable base.

DETAILED DESCRIPTION OF THE PREFERRED EMBODIMENTS

Figure 1:
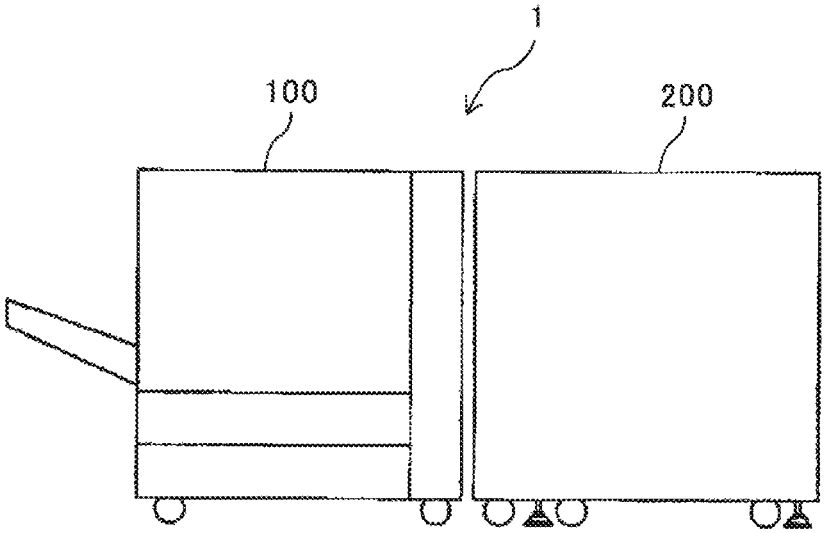
FIG. 1 is a schematic view illustrating an image forming system according to a present embodiment.

Hereinafter, an embodiment of a feeding device to which an embodiment of the present invention is applied will be described. FIG. 1 is a schematic view illustrating a configuration of an image forming system 1 according to a present embodiment. As illustrated in FIG. 1, the image forming system 1 includes an image forming apparatus 100 as an image forming unit configured to form an image on a sheet, and a feeding device 200 configured to feed a sheet to the image forming apparatus 100. The feeding device 200 is disposed on a side of a body of the image forming apparatus 100.

A recording method of the image forming apparatus 100 to which the feeding device according to the present embodiment is applicable is not particularly specified, and any method, such as an electrophotographic method or an ink jet method, may be employed. In FIG. 1, a sheet conveying unit configured to convey sheets from the sheet feeding device 200 is disposed on a right side of a body of the image forming apparatus 100. The sheet conveying unit is provided with an opening for receiving a sheet, and a conveying unit for conveying the received sheet.

Figure 2:
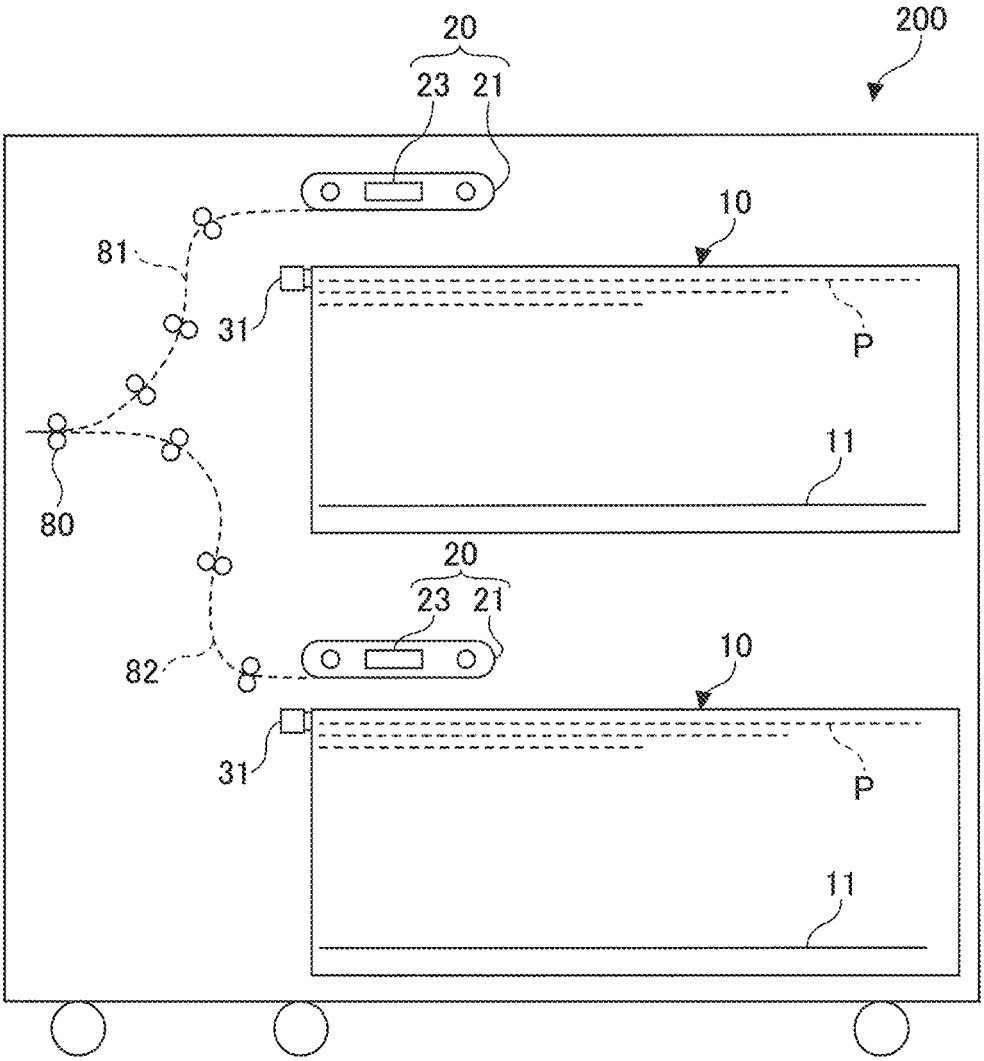
FIG. 2 is a schematic view illustrating a feeding device according to the present embodiment.

FIG. 2 is a schematic view illustrating a feeding device 200 according to the present embodiment, which is disposed on a side of the body of the image forming apparatus 100. The feeding device 200 includes upper and lower feeding trays 10. Each of the feeding trays 10 includes a sheet loading base 11 acting as a lifting member 11 for use in loading of a bundle of sheet P (hereinafter called a "sheet bundle P"). In the present embodiment, each of the feeding trays 10 can accommodate up to approximately 2500 sheets.

Note that examples of an object to be conveyed include sheets of paper, coated paper, label paper, OHP sheets, films, prepregs, and the like. Prepregs are mainly used as materials for laminated plates and multilayer printed circuit boards. For example, such materials may be sheet materials processed by continuously impregnating a long base material such as glass cloth, paper, non-woven fabric, or aramid cloth with a resin varnish made mainly from a thermosetting resin such as epoxy resin and polyimide resin, and cutting the varnish after heating and drying. Examples of the sheets may include bag-like sheets, such as envelopes, wrappers, and the like.

A feeding unit 20 is disposed above each of the feeding trays 10 as a conveying unit configured to suction and convey a top sheet of the sheet bundle P loaded on the corresponding feeding tray 10. The feeding unit 20 includes a suction belt 21 acting as a conveying member and a suction device 23.

The sheet loaded on the lower feeding tray 10 passes through a lower conveying passage 82, and is then conveyed by a pair of outlet rollers 80 to the body of the image forming apparatus 100. The sheet loaded on the upper feeding tray 10 passes through an upper conveying passage 81, and is then conveyed by the pair of outlet rollers 80 to the body of the image forming apparatus 100.

Figure 3:
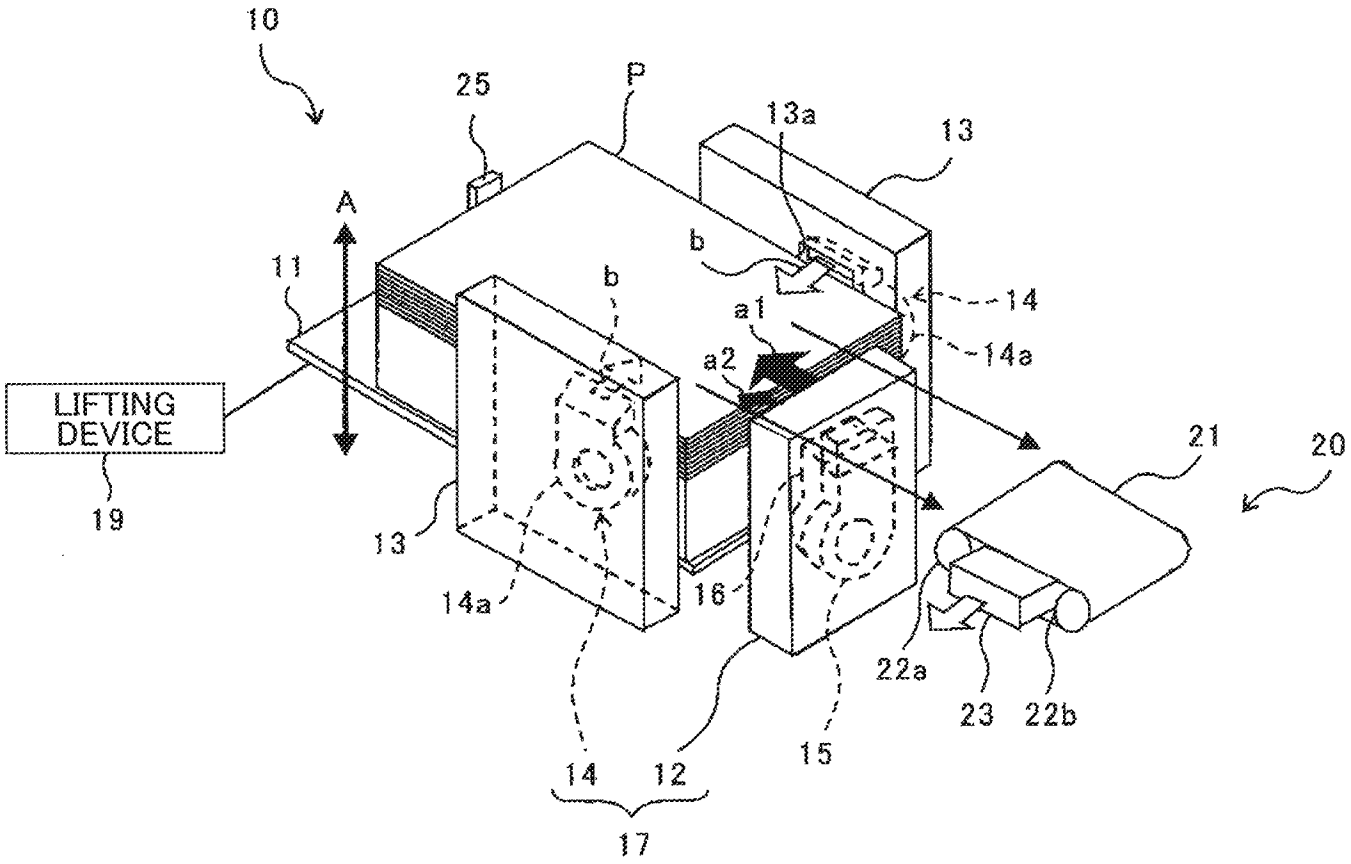
FIG. 3 is a schematic perspective view illustrating the vicinity of a feeding tray.

FIG. 3 is a schematic perspective view illustrating the vicinity of the feeding tray 10. In FIG. 3, the feeding unit 20 is shifted from an original position indicated by two thin arrows for convenience. The suction belt 21 of the feeding unit 20 is stretched by two stretching rollers 22*a* and 22*b*, and suction pores passing from a surface to a rear surface of the suction belt 21 are provided throughout a circumferential direction of the suction belt 21. A suction device 23 is disposed inside the suction belt 21. The suction device 23 is connected to a suction fan configured to suck air through an air duct acting as an air flow passage. The suction device 23 generates negative pressure downward so as to suction a sheet onto a lower surface of the suction belt 21.

The feeding tray 10 is provided with a blowing device 17 acting as an air blowing unit configured to blow air to the upper sheet of the sheet bundle P. The blowing device 17 includes a front blowing device 12 and a side blowing device 14.

The side blowing devices 14 are disposed on respective side fences 13 forming a pair to blow air to an upper side of the sheet bundle P in directions indicated by arrows b in FIG. 3. Each of the side blowing devices 14 is provided with a side floating nozzle that separates the sheet bundle P and guides the air in a floating direction. The side blowing devices 14 each have a side blower 14*a* that feeds air to the side floating nozzle. The air blown from the side floating nozzle in the directions indicated by the arrows b in the drawing is called side air. The side air is discharged from a side nozzle 13*a* disposed on a corresponding side fence 13 at a position facing an upper part of the sheet bundle P, and is blown onto a side surface of the upper part of the sheet bundle P. The sheets at the upper part of the sheet bundle P is floated by air blown from the front blowing device 12 and from outlets of the pair of side fences 13.

Further, the feeding tray 10 is provided with an end fence 25 configured to align a rear end of the sheet bundle P loaded on the sheet loading base 11. The sheet loading base 11 is configured to be raised and lowered in an arrow A direction in FIG. 3 by a lifting device 19 acting as a lifting unit.

Figure 4:
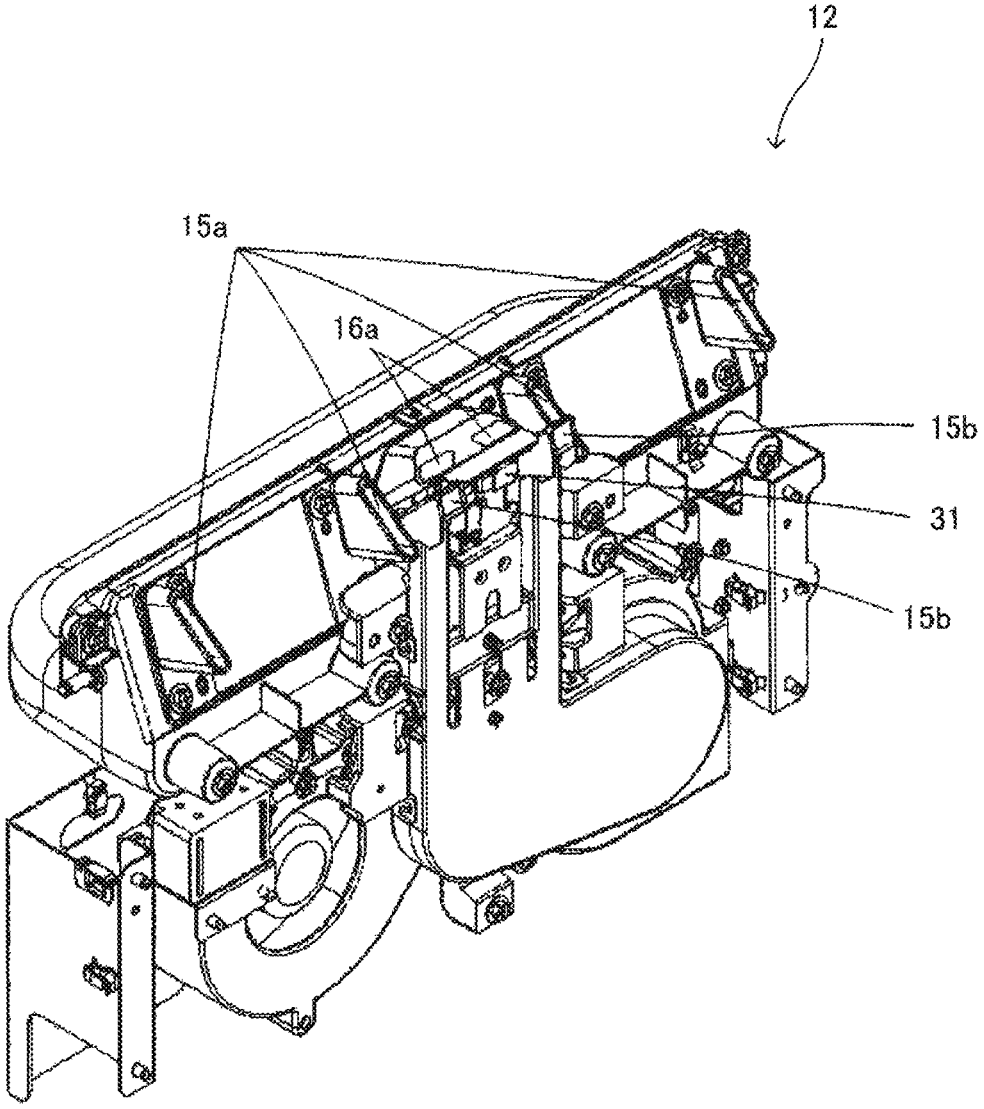
FIG. 4 is a perspective view illustrating a front blowing device.
Figure 5:
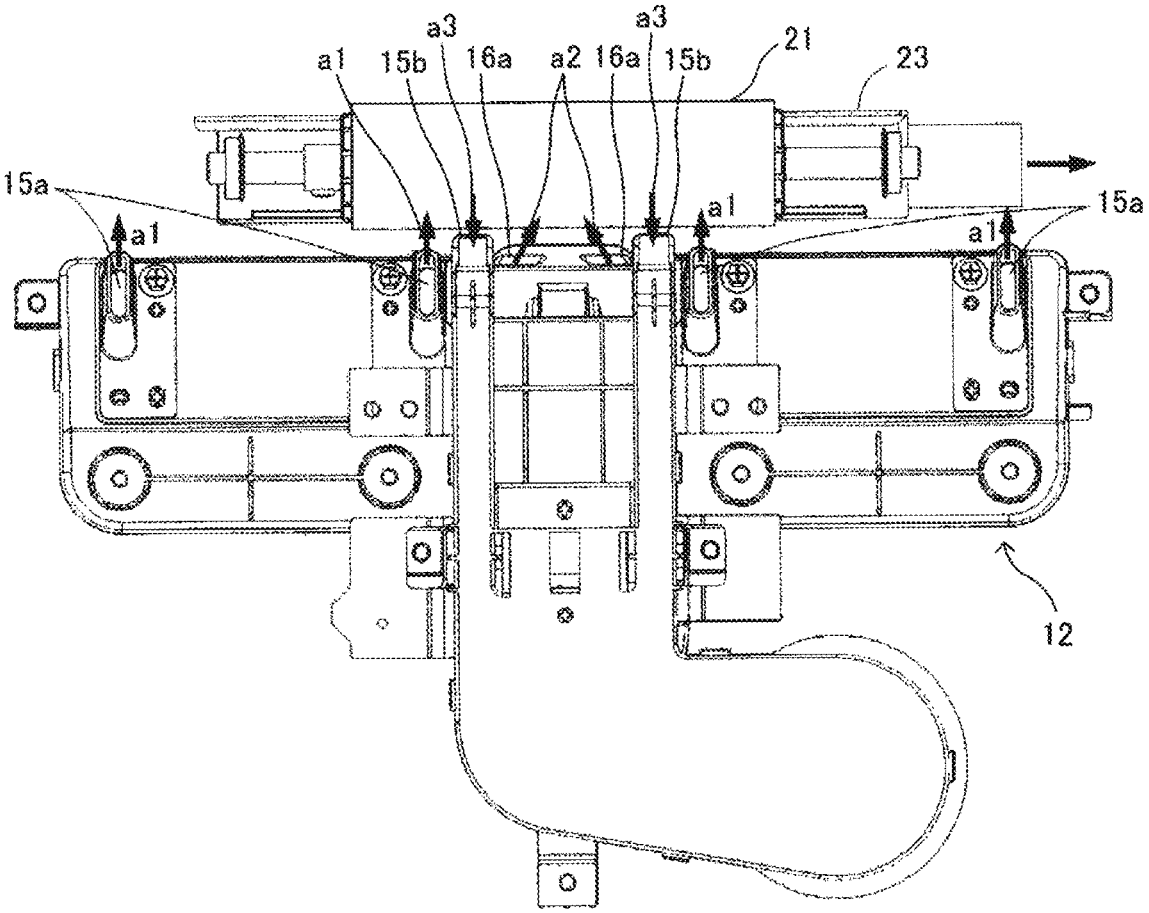
FIG. 5 is a front view illustrating the front blowing device.

FIG. 4 is a perspective view illustrating the front blowing device 12, and FIG. 5 is a front view illustrating the front blowing device 12. The front blowing device 12 is configured to blow air to an upper front end (downstream end in the feeding direction) of the sheet bundle P. The front blowing device 12 includes a floating nozzle 15*a* configured to guide air in a floating direction of the sheet bundle P, a separating nozzle 16*a* configured to guide air to separate between a top floating sheet and a second floating sheet, and a lower suction nozzle 15*b* configured to suction air near an upper end of the sheet bundle P downward.

Of air blown from these nozzles, air blown from the floating nozzle 15*a* is called floating air, and air blown from the separating nozzle 16*a* is called separating air. The air sucked from the lower suction nozzle 15*b* is called a lower suction air.

The floating air is blown in arrow a1 directions in FIGS. 3 and 5 from a position facing the upper end of the sheet bundle P (a downstream end in the feeding direction of the sheet bundle P), and blown toward the upper end of the sheet bundle P (the downstream end in the feeding direction of the sheet bundle P). The separating air is blown in arrow a2 directions illustrated in FIGS. 3 and 5 from the position facing the upper end of the sheet bundle P (the downstream end in the feed direction) and is blown between a top sheet suctioned onto the suction belt 21 and the floating second sheet.

The lower suction air flows in arrow a3 directions illustrated in FIG. 5 and is sucked by the lower suction nozzle 15*b*, such that a negative pressure is generated near the upper end of the sheet bundle P. This generates a force in a direction separating from the suction belt 21, allowing the floating second and subsequent sheets to drop quickly onto the sheet bundle.

Next, a feeding operation will be described. When a command to start feeding is received from an upper controller of the body of the image forming apparatus 100, the lifting device 19 is driven to raise the sheet loading base 11. When the sheet detecting sensor 31 detects a top surface of the sheet bundle P, the driving of the lifting device 19 is stopped. Next, the blowing of the blowing device 17 is started while the suction belt 21 is stopped, and blowing control is subsequently started. In addition, suction of the suction device 23 is started, and suction control is subsequently started. When the blowing of the blowing device 17 is started, floating air, separating air, and side air are blown to an upper front end of the sheet bundle P, from the floating nozzle 15*a*, the separating nozzle 16*a*, and the side nozzle 13*a*.

The front ends of the plurality of sheets of the upper part of the sheet bundle P are floated by blowing of floating air and the side air, and a negative pressure is generated below the suction belt 21 by suctioning of the suction device 23. The floating top sheet P1 is suctioned onto the suction belt 21. When the top sheet P1 is suctioned onto the suction belt 21, separating air is blown from the separation nozzle 16*a* between the top sheet P1 and the second sheet P2, and the suctioned top sheet P1 and the second and subsequent sheets are separated.

Next, the suction belt 21 is rotated to feed the top sheet P1. In this case, when the second and subsequent sheets come into contact with the top sheet, due to excessive floating or disturbing behaviors of the sheets, the second and subsequent sheets may be conveyed together with the top sheet. Thus, according to the present embodiment, when the feeding of the top sheet P1 is started (when the suction belt 21 is rotated), blowing of the front floating air and blowing of the separating air stop, and air suctioning from the lower suction nozzle 15*b* starts. This prevents duplicated feeding by allowing the second and subsequent floating sheets to drop quickly so as not to be in contact with the top sheet.

When a predetermined time has elapsed from the start of feeding, that is, when a front end of the top sheet P1 is fed to a predetermined next process unit (such as a pair of conveying rollers) at a downstream side of the suction belt, the suctioning by the suction device 23 stops, and the first sheet suctioned onto the suction belt 21 is released. Further, the driving of a feeding motor also stops so as to stop the rotation of the suction belt 21.

When a next sheet to be fed is present, blowing of the front floating air and separate air is resumed, and suctioning of air from the lower suction nozzle 15*b* is stopped. This removes hindrance to floating of the next sheet exerted by the lower suction air. Next, the suction device 23 resumes suctioning of the sheet to the suction belt 21. Thereafter, the same feeding process as described above is performed.

When an image is formed on a sheet having a large thickness deviation in the sheet conveying direction such as a bag-like sheet having a zipper at an opening portion, such a bag-like sheet is set on the feeding tray 10 such that a thin side of the bag-like sheet is oriented as a front end in the sheet conveying direction, in consideration of the conveying efficiency. This is because when a thick side of the bag-like sheet is oriented as the front end in the sheet conveying direction, the front end of the sheet impinges on a guide member or the conveying rollers, and the bag-like sheet is not smoothly conveyed to a nip of the pair of conveying rollers, thereby increasing a risk of jamming.

When a plurality of bag-like sheets having a large thickness deviation in the sheet conveying direction is stacked as a sheet bundle, such a sheet bundle has a thick portion spreading in a fan-shape. When the fan-shape spreading end of the sheet bundle is set on the feeding tray 10 by being oriented as a rear end side in the sheet conveying direction, the following problems arise.

Figure 6:
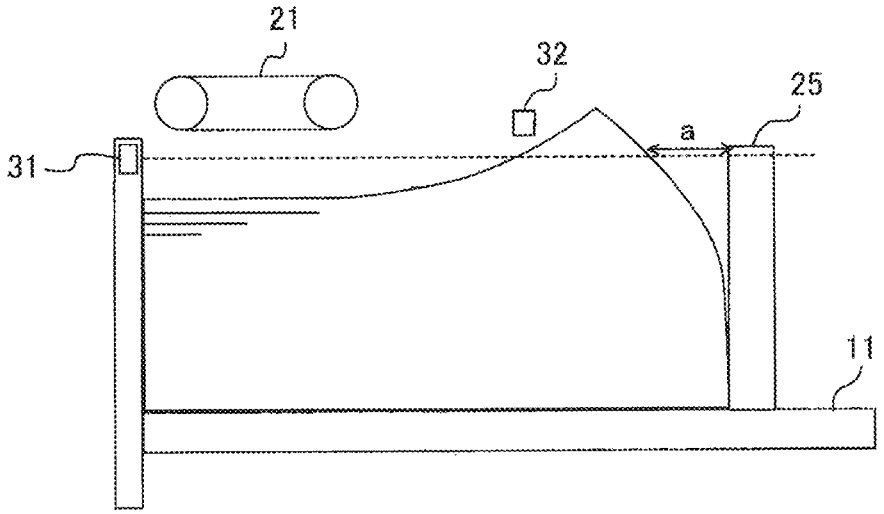
FIG. 6 is a schematic view illustrating a related art feeding device on which a fan-shaped spread sheet bundle is set.

FIG. 6 is a schematic view illustrating a case in which a fan-shape spreading sheet bundle P is set in a related art feeding device. As described above, in order to set the thick side of the sheet bundle as the rear side in the sheet conveying direction for facilitating conveying efficiency, the sheet bundle is set on the feeding tray 10 by setting the fan-shape spreading end of the sheet bundle as the rear end in the sheet conveying direction, as illustrated in FIG. 6. Next, when the end fence 25 is moved in the sheet conveying direction to restrict a position of the sheet bundle, a gap a is formed between an upper side of the sheet bundle and the end fence 25. This indicates that an upper side position of the sheet bundle cannot be restricted by the end fence 25. As described above, when such a gap a is formed, the floating top sheet is retracted by the gap a, the top sheet and a front end of the second sheet face the suction belt 21, and the front end of the second sheet is suctioned onto the suction belt 21 together with the top sheet. As a result, the two sheets are conveyed together, and duplicated feeding occurs.

In addition, the height of the rear end side of the sheet bundle loaded on the sheet loading base 11 becomes high. An end sensor 32 configured to detect the presence or absence of a sheet to indicate out-of-sheet is disposed on a more upstream side in the sheet conveying direction than the suction belt 21. Since the rear end side of the sheet bundle loaded on the sheet loading base 11 becomes high, the end sensor 32 detects the presence of a sheet, but the sheet detecting sensor 31 detects the absence of a sheet.

According to the feeding device, when the sheet detecting sensor 31 receives light reflected from a sheet or the sheet loading base 11 to detect the presence of a sheet, and when the end sensor 32 receives light reflected from the sheet to detect the presence of a sheet, the driving of the lifting device 19 is stopped. Meanwhile, when the sheet detecting sensor 31 detects the presence of a sheet, but the end sensor 32 does not receive the reflected light and detects the absence of a sheet, the lifting device 19 further elevates the sheet loading base 11 by a predetermined amount. When the end sensor 32 still detects the absence of a sheet, the out-of-sheet is determined, thereby prompting the feeding device to set new sheets. As described above, the driving of the lifting device 19 is controlled based on a condition in which when the end sensor 32 detects the presence of a sheet, the sheet detecting sensor 31 always detects the presence of a sheet. Thus, an irregular case may occur in which the end sensor 32 detects the presence of a sheet but the sheet detecting sensor 31 detects the absence of a sheet. In such a case, depending on a driving control technique of the lifting device 19, a problem such as the lifting control of the lifting device 19 being not performed correctly may arise.

In addition, since the rear side of the upper part of the sheet bundle is largely curved upward, a restoring force acts downward on the front end side of the sheets. As a result, the top sheet of the sheet bundle is difficult to float, such that the top sheet may not be suctioned onto the suction belt 21.

As described above, when a large number of sheets each having a thickness deviation in the conveying direction is bundled, the fan-shape spreading of the sheet bundle increases, and the aforementioned problem arises. Thus, when an image is formed on a sheet having a large thickness deviation in the conveying direction, only a few sheets can be set as a sheet bundle on the feeding tray 10. This reduces the productivity.

Thus, according to the present embodiment, even when a sheet bundle composed of a large number of sheets each having a thickness deviation in a sheet conveying direction is set on the feeding tray 10, the sheet bundle can be conveyed efficiently without the above-described problem. Hereinafter, features of the present embodiment will be described in detail.

Figure 7:
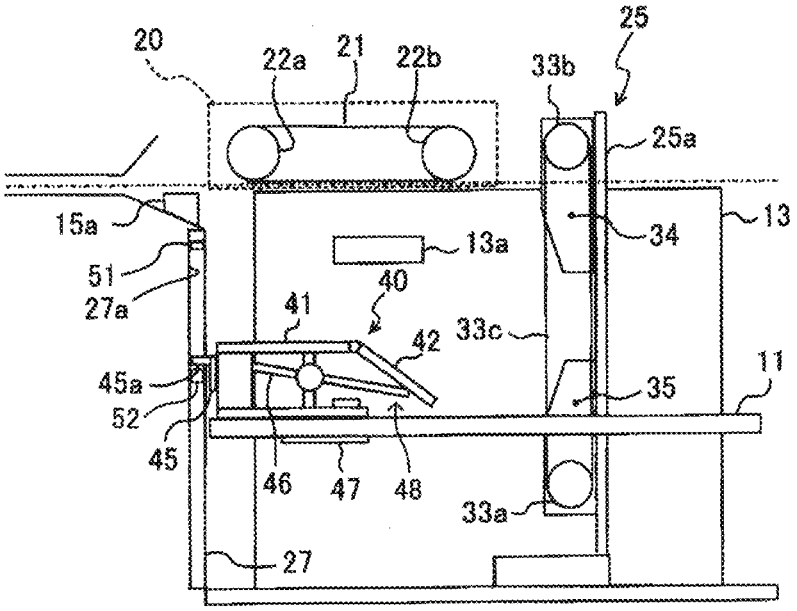
FIG. 7 is a schematic view illustrating features of the feeding device according to the present embodiment.
Figure 8:
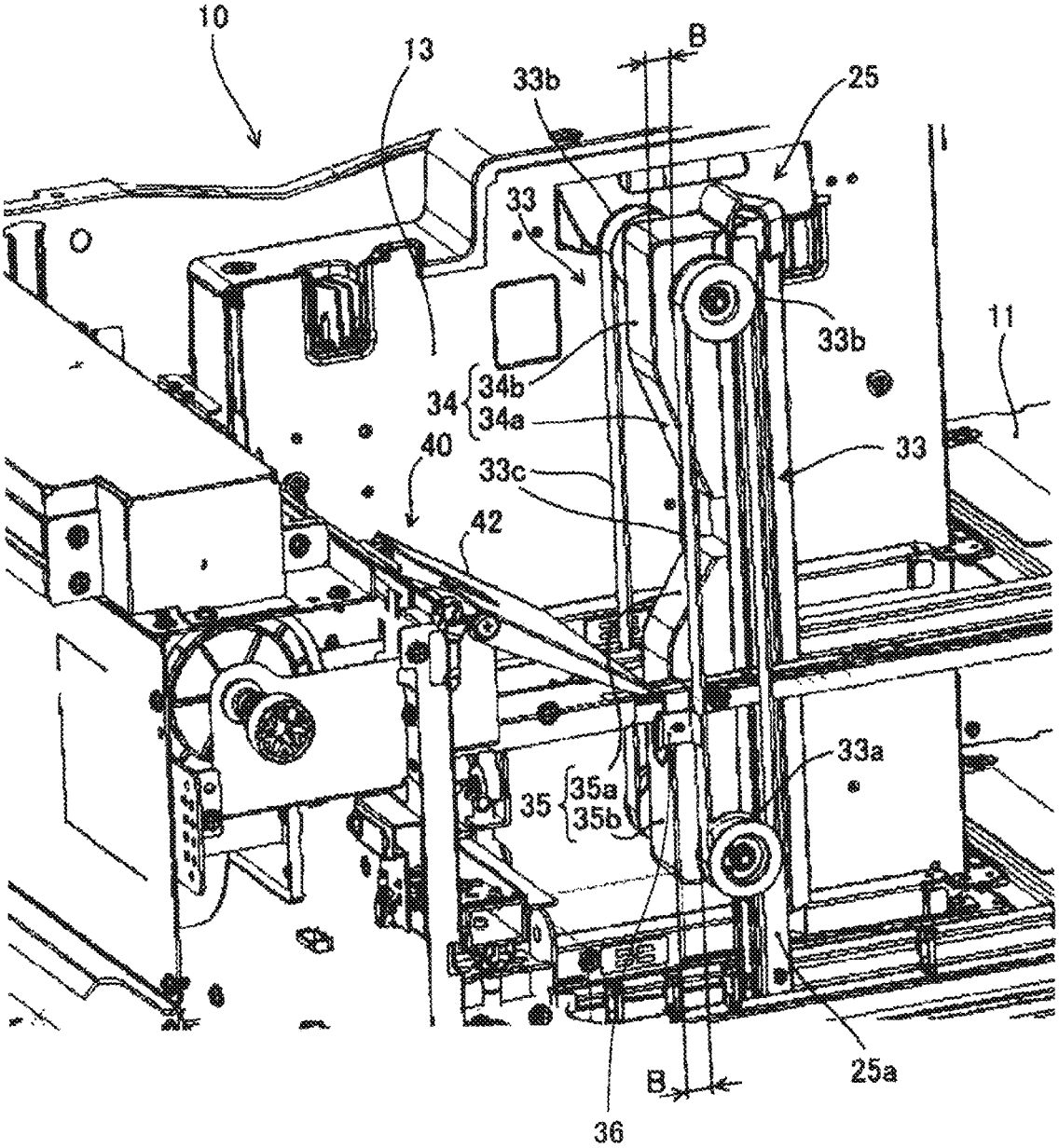
FIG. 8 is a schematic perspective view illustrating the vicinity of the feeding tray.

FIG. 7 is a schematic view illustrating features of the feeding device according to the present embodiment, and FIG. 8 is a schematic perspective view illustrating the vicinity of the feeding tray 10. As illustrated in FIGS. 7 and 8, the end fence 25 according to the present embodiment includes a supporting post 25*a*, which is movably supported on the bottom of the feeding tray 10 in the sheet conveying direction. A lower restriction member 35 and an upper restriction member 34 are disposed on a facing surface of the supporting post 25*a* that faces the sheet bundle. The lower restriction member 35 is configured to abut against a rear end of a lower part of the sheet bundle to restrict a position of the rear end of the lower part of the sheet bundle, and the upper restriction member 34 is configured to abut against a rear end of an upper part of the sheet bundle to restrict a position of the rear end of the upper part of the sheet bundle.

A pair of belt controllers 33 are disposed on two ends in a sheet width direction of the restriction members 34 and 35. Each of the belt controllers 33 includes an upper stretching roller 33*b* configured to be rotatably supported by the upper restriction member 34, a lower stretching roller 33*a* configured to be rotatably supported by the lower restriction member 35, and a belt member 33*c* acting as an elastic deformation member configured to be stretched between the stretching roller 33*a* and the stretching roller 33*b*.

Further, the pair of the belt controllers 33 has the same configuration, such that tension of the belt member 33*c* on one side of the belt controller 33 and tension of the belt member 33*c* on the other side of the belt controller 33 are the same. In addition, the tension of the belt members 33*c* may each preferably be lower. The weak (lower) tension of the belt members 33*c* allows for easy elastic deformation such that the belt members 33*c* deform along the fan-shape spreading rear end of the sheet bundle. Note that when the tension is reduced, the belt members 33*c* may fail to restrict the rear end position of the sheet bundle correctly, so that the front end of the sheet bundle cannot be pressed against a front fence 27. However, according to the present embodiment, the upper restriction member is disposed to restrict the rear end position of the sheet bundle correctly. Thus, a problem such as duplicated feeding will not occur.

Further, at least one of the upper restriction member 34 or the lower restriction member 35 may be provided with a plurality of vertically aligned holes for rotatably supporting the stretching rollers, thereby adjusting the tension of the belt member 33*c*.

In such a configuration, the tension of the belt member 33*c* can be adjusted by changing (selecting) the holes for supporting the stretching rollers 33*a* and 33*b*.

The stretching rollers 33*a* and 33*b* are rotatably supported by the restriction members 34 and 35. As will be described later, the respective belt members 33*c* that come in contact with the rear end of the sheet are capable of moving endlessly in accordance with the rising of the sheet. Further, surfaces of the belt members 33*c* are uneven or rough surfaces so that the sheet in contact with the belt members does not easily slide on the surfaces of the belt members 33*c*.

As illustrated in FIG. 8, the upper restriction member 34 is attached to an upper part of the supporting post 25*a*. The upper restriction member 34 includes a contact surface 34*b* parallel to a vertical direction, and a guiding slope 34*a* inclined downward from a lower end of the contact surface 34*b* to be separated from the sheet bundle along a downward direction from the lower end of the contact surface 34*b*.

The lower restriction member 35 has the same shape as the upper restriction member 34, and is attached to a lower part of the supporting post 25*a* in an inverse (upside down) orientation of the upper restriction member 34. Accordingly, a guiding slope 35*a* of the lower restriction member 35 is inclined upward from an upper end of the contact surface 35*b* to be separated from the sheet bundle along an upward direction from the upper end of the contact surface 35*b*.

Further, the contact surfaces 34*b* and 35*b* of the respective restriction members 34 and 35 are each located B mm closer toward the sheet bundle than stretched surfaces of the belt members 33*c* that face the sheet bundle.

Moreover, a fixed-movable loading unit 40 acting as a second loading unit is attached to a downstream side in the sheet conveying direction of the sheet loading base 11 acting as a lifting member. The fixed-movable loading unit 40 includes a fixing base 41 configured to support a front end side in the conveying direction of the sheet bundle, and a movable base 42 configured to rotate by a link mechanism 48. The link mechanism 48 includes first and second rotating members 45 and 46. The first rotating member 45 is provided with a movable protrusion 45*a* configured to come in contact with a first protrusion 51 to move the movable base 42, where the first protrusion 51 is disposed in a guide groove 27*a* configured to guide the sheet loading base 11 of the front fence 27.

Figure 9:
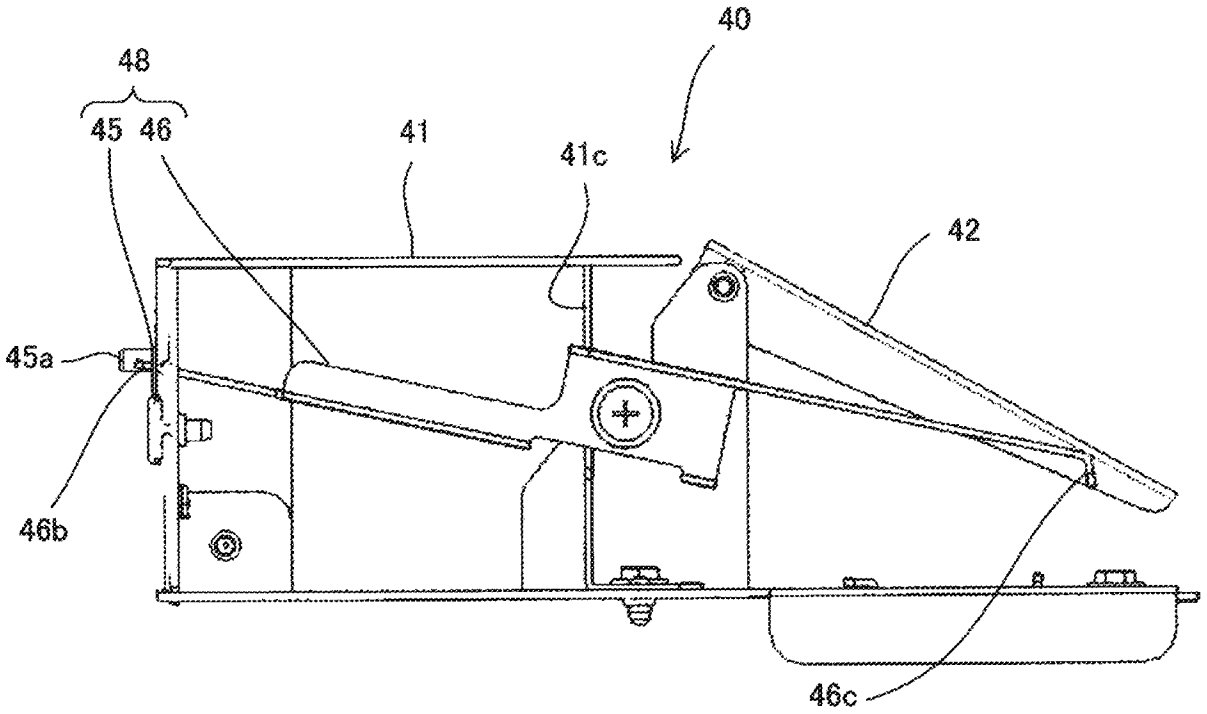
FIG. 9 is a schematic view illustrating a loading unit.
Figure 10:
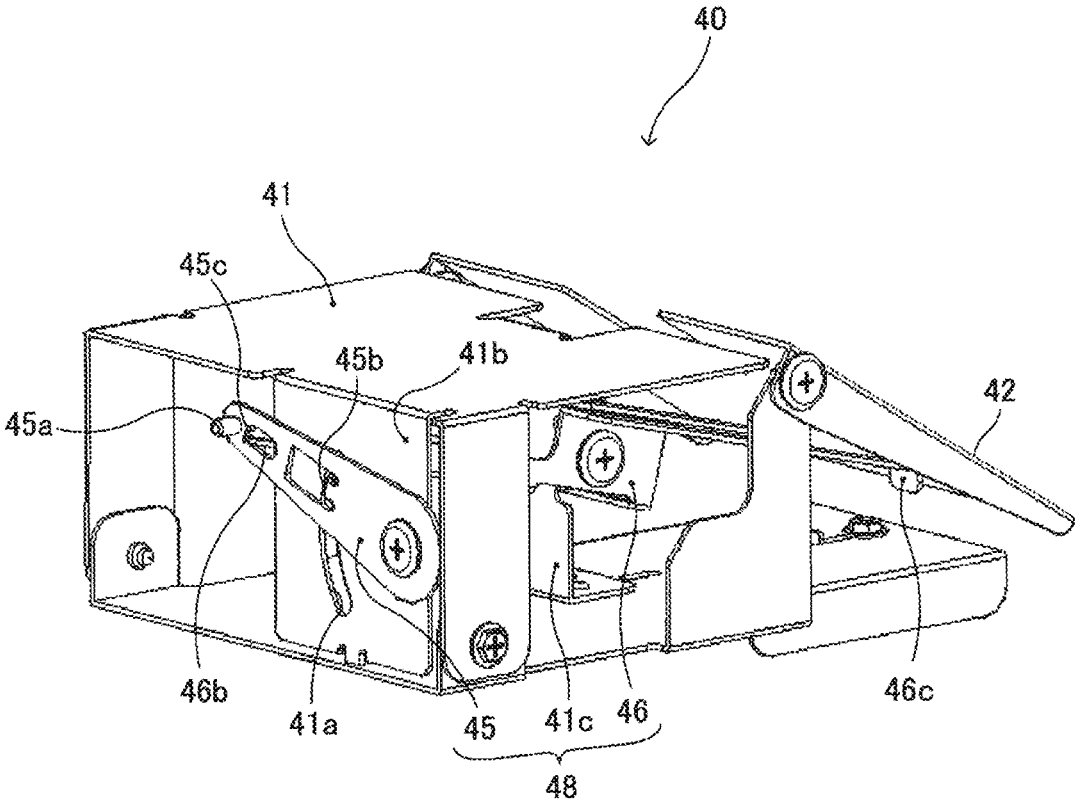
FIG. 10 is a perspective view illustrating the loading unit.

FIG. 9 is a schematic view illustrating a configuration of a fixed-movable loading unit 40, and FIG. 10 is a perspective view illustrating the fixed-movable loading unit 40. One end of the first rotating member 45 constituting the link mechanism 48 is rotatably supported on a facing surface 41*b* that faces the front fence 27. The other end of the first rotating member 45 is provided with the movable protrusion 45*a*. Further, a through-hole 45*c* through which the coupling portion 46*b* of the second rotating member 46 penetrates is provided adjacent the movable protrusion 45*a*.

A restriction hole 41*a* configured to restrict a rotation range of the first rotating member 45 is disposed on the facing surface 41*b*, and a restriction protrusion 45*b* bent toward an upstream side in the sheet conveying direction is formed substantially at the center of the first rotating member 45 such that the restriction protrusion 45*b* is inserted into the restriction hole 41*a*. Such a configuration restricts the rotation range of the first rotating member 45 to less than 90 degrees.

The substantially central portion of the second rotating member 46 is rotatably supported by the base supporting portion 41*c*. The base supporting portion 41*c* is configured to support an upstream side in the sheet conveying direction of the fixing base 41. A coupling portion 46*b* configured to couple to the first rotating member 45 is formed at a downstream end in the sheet conveying direction of the second rotating member 46, as described above. Further, a contact portion 46*c* is disposed at an upstream end in the sheet conveying direction of the second rotating member 46 to come in contact with a rear surface of the movable base 42 to rotate the movable base 42.

The coupling portion 46*b* of the second rotating member 46 is coupled to the restricted first rotating member 45 so that the rotation range of the second rotating member 46 is also limited to less than 90 degrees. Thus, making the rotation range of each of the rotating members constituting the link mechanism 48 less than 90 degrees will prevent the fixed-movable loading unit 40 from becoming larger.

When the movable protrusion 45*a* is not in contact with the first protrusion 51, the contact portion 46*c* of the second rotating member 46 is pushed in by the weight of the movable base 42 to lower the contact portion 46*c*, and the movable base 42 is in a tilted orientation. Of the second rotating member 46, the contact portion 46*c* is lowered and the coupling portion 46*b* is raised. Of the first rotating member 45, the movable protrusion 45*a* is located at an upper position.

Figure 11A:
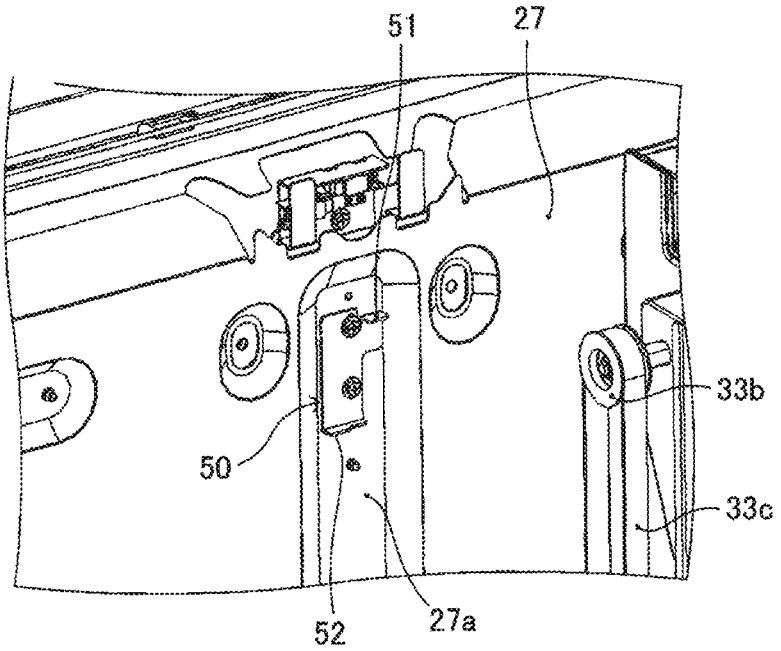
FIG. 11A and FIG. 11B are perspective views illustrating the feeding tray viewed from an upstream side in the sheet conveying direction.
Figure 11B:
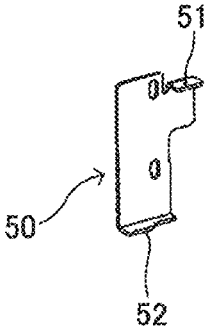

FIG. 11A is a perspective view illustrating the feeding tray 10 viewed from the upstream side in the sheet conveying direction, and FIG. 11B is a perspective view illustrating a stopper member 50. As illustrated in FIGS. 11A and 11B, the stopper member 50 is screwed on an upper part of a guide groove 27*a* of the front fence 27. The front fence 27 is configured to abut against a front end of the sheet bundle on the feeding tray 10 to restrict a position of the front end of the sheet bundle. The guide groove 27*a* is configured to guide raising or lowering of the sheet loading base 11 of the front fence 27.

A first protrusion 51, with which the movable protrusion 45*a* of the fixed-movable loading unit 40 comes in contact, is formed on an upper end of the stopper member 50, and a second protrusion 52, with which the movable protrusion 181*a* of the later-described movable-movable loading unit 140 (see FIGS. 23A and 23B) comes in contact, is formed on a lower end of the stopper member 50. The first protrusion 51 is disposed at a position deviating from the second protrusion 52 in the sheet width direction.

Figure 12:
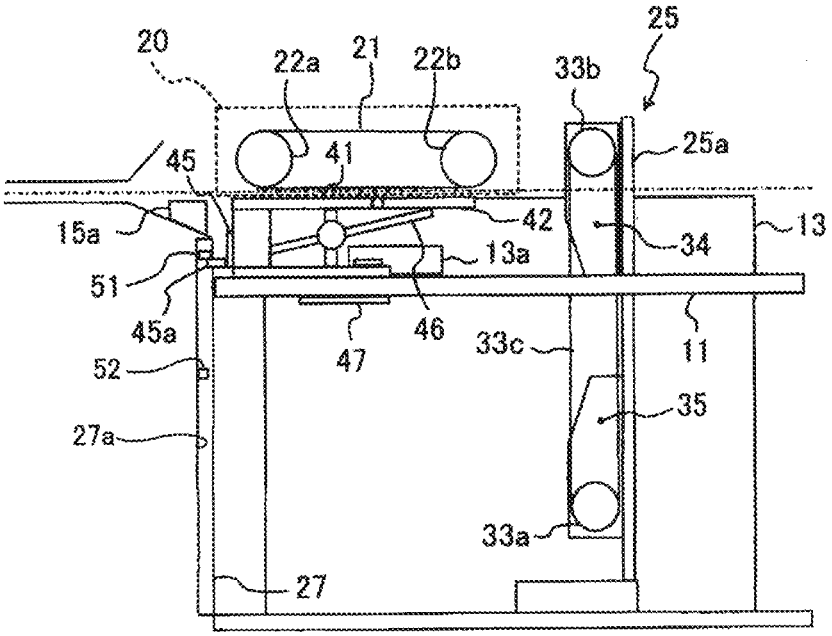
FIG. 12 is a schematic view illustrating a configuration when a fixing base reaches a feeding position.
Figure 13:
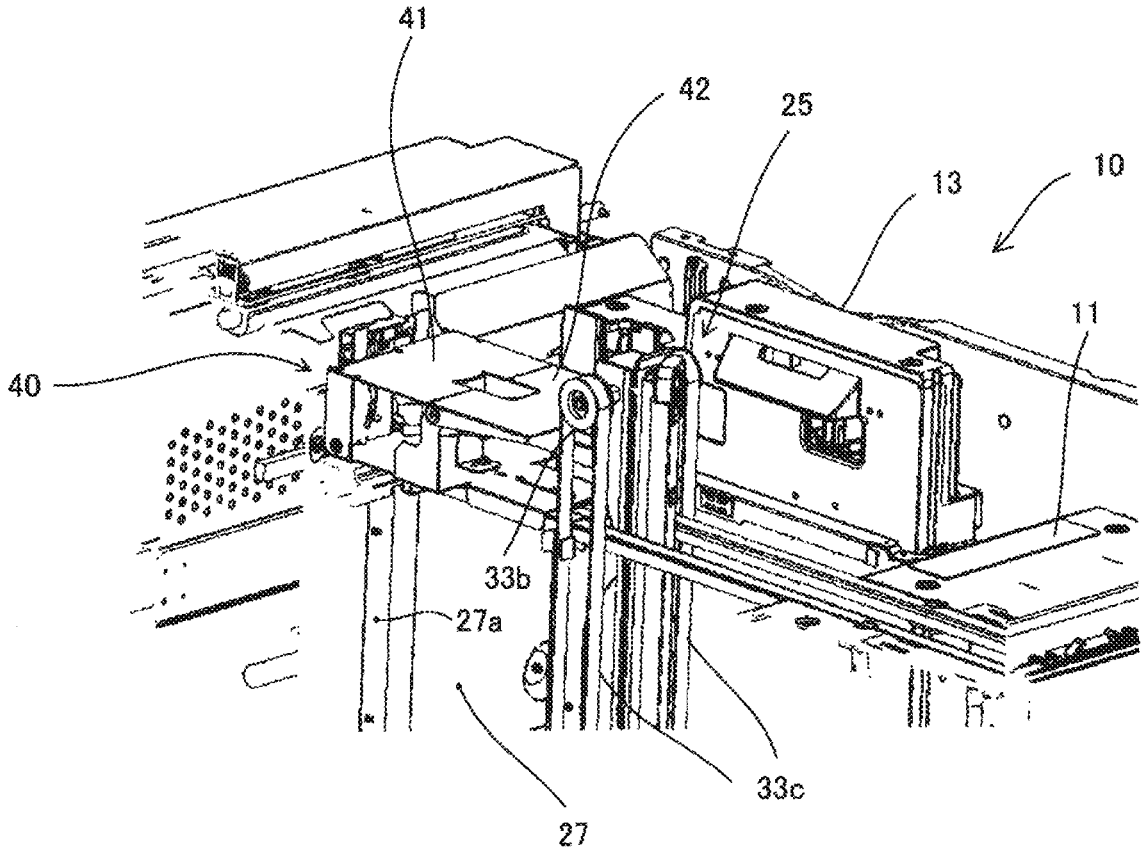
FIG. 13 is a perspective view illustrating the feeding tray viewed from the upstream side in the sheet conveying direction when the fixing base reaches the feeding position.
Figure 14:
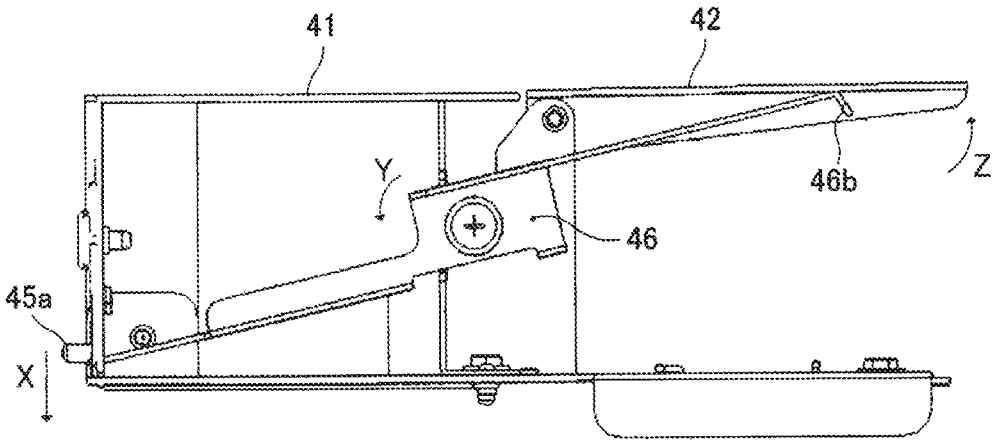
FIG. 14 is a schematic view illustrating the loading unit when the fixing base reaches the feeding position.
Figure 15:
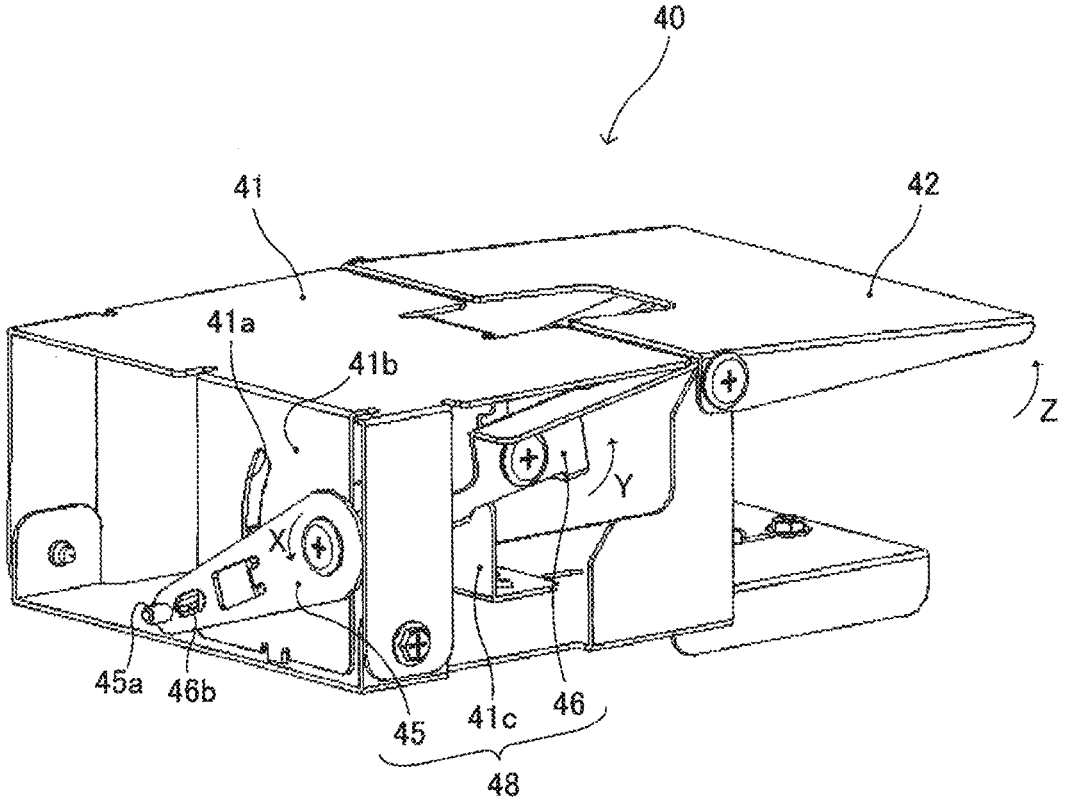
FIG. 15 is a perspective view illustrating the loading unit when the fixing base reaches the feeding position.

FIG. 12 is a schematic view illustrating a configuration when the fixing base 41 reaches the feeding position, and FIG. 13 is a perspective view viewed from the upstream side in the sheet conveying direction of the feeding tray 10 when the fixing base 41 reaches the feeding position. FIG. 14 is a schematic view illustrating a state of a fixed-movable loading unit 40 when the fixing base 41 reaches the feeding position, and FIG. 15 is a perspective view illustrating a fixed-movable loading unit 40 when the fixing base 41 reaches the feeding position. When the fixed-movable loading unit 40 attached to the sheet loading base 11 moves up with the sheet loading base 11, the movable protrusion 45*a* comes in contact with the first protrusion 51. When the fixed-movable loading unit 40 is raised further from the above state, the first protrusion 51 restricts the elevation of the movable protrusion 45*a*. Then, the first rotating member 45 rotates in an arrow X direction as illustrated in FIG. 14 against the weight of the sheet bundle loaded on the movable base 42 and the fixed-movable loading unit 40, and the movable protrusion 45*a* moves downward relative to the fixed-movable loading unit 40. As the first rotating member 45 rotates in the arrow X direction in FIG. 14, the coupling portion 46*b* of the second rotating member 46 is lowered. As a result, the second rotating member 46 rotates in an arrow Y direction in FIG. 14, and the contact portion 46*c* lifts the movable base 42, as illustrated in FIGS. 13 and 14. As a result, the movable base 42 rotates in an arrow Z direction in FIG. 14 to make the tilting to be gradual. Then, as illustrated in FIG. 12, when the fixing base 41 reaches the feeding position, the movable base 42 is in a horizontal orientation.

According to the present embodiment, the link mechanism 48 is disposed such that the movable base 42 is rotated as the sheet loading base 11 rises. This configuration can remove the need for a motor for rotatably driving the movable base 42 to reduce the cost of the device.

Figure 16:
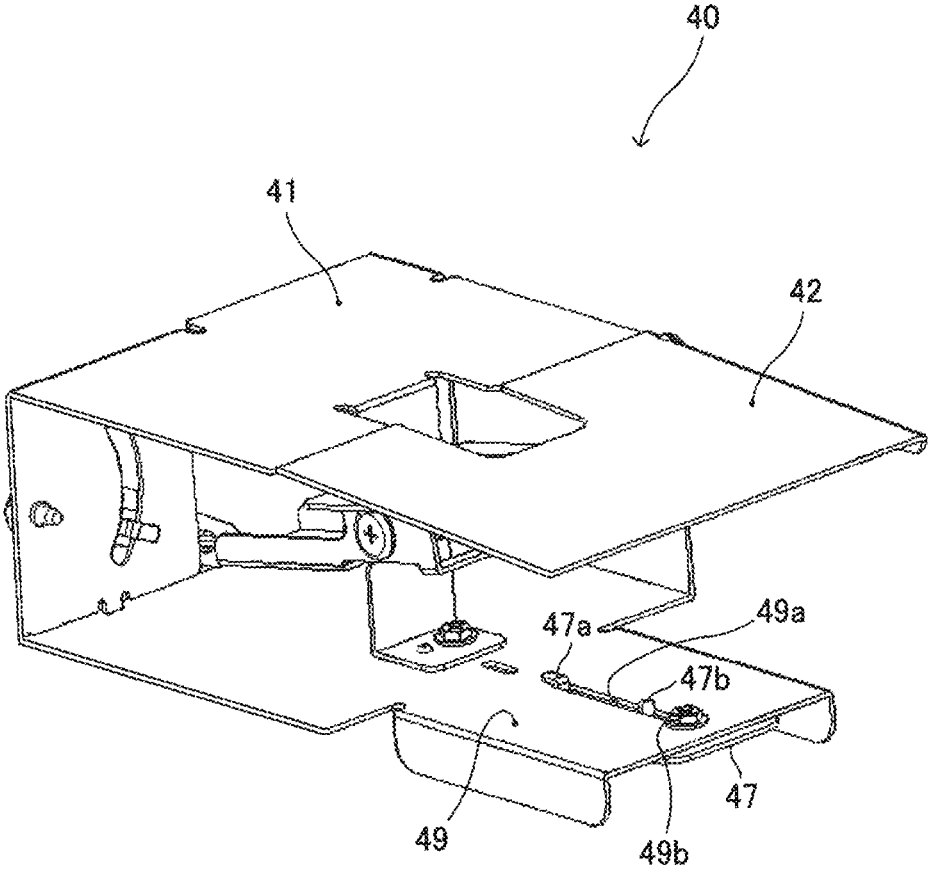
FIG. 16 is a perspective cross-sectional view illustrating the loading unit viewed from an upstream side in the sheet conveying direction.
Figure 17A:
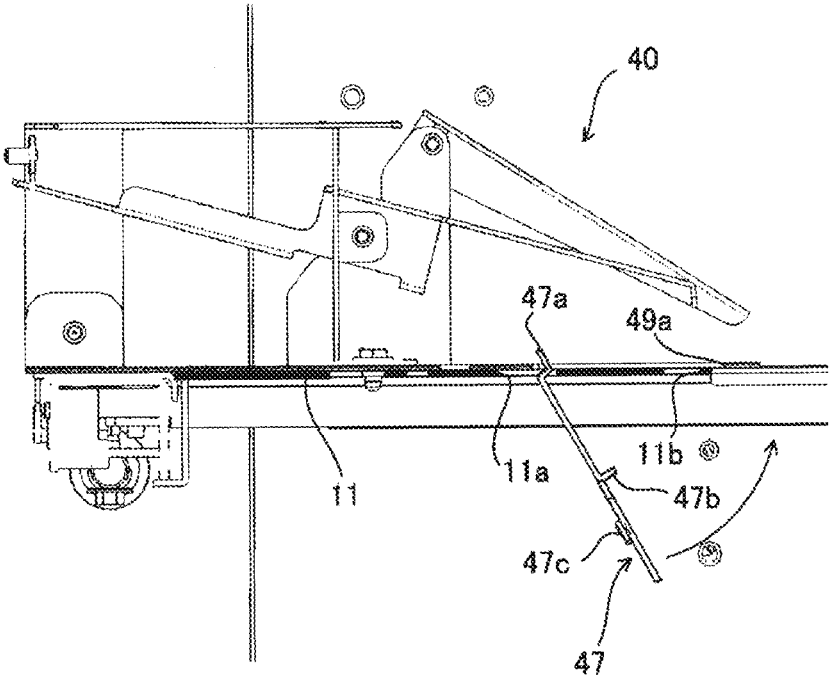
FIGS. 17A to 17C are views illustrating the loading unit attached to a sheet loading base.
Figure 17B:
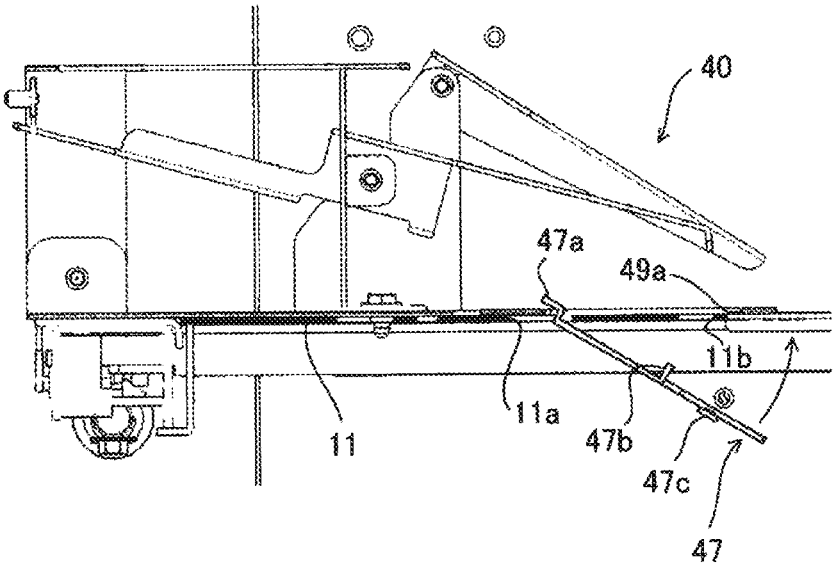
Figure 17C:
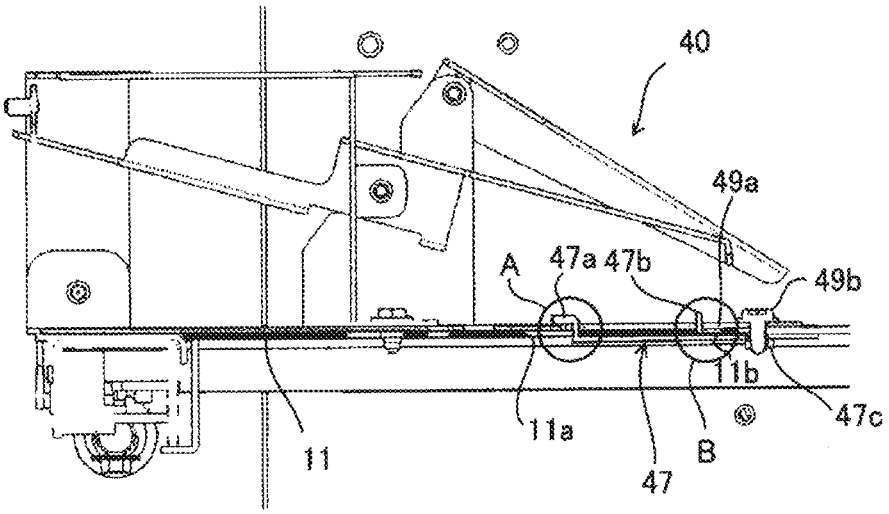
Figure 18A:
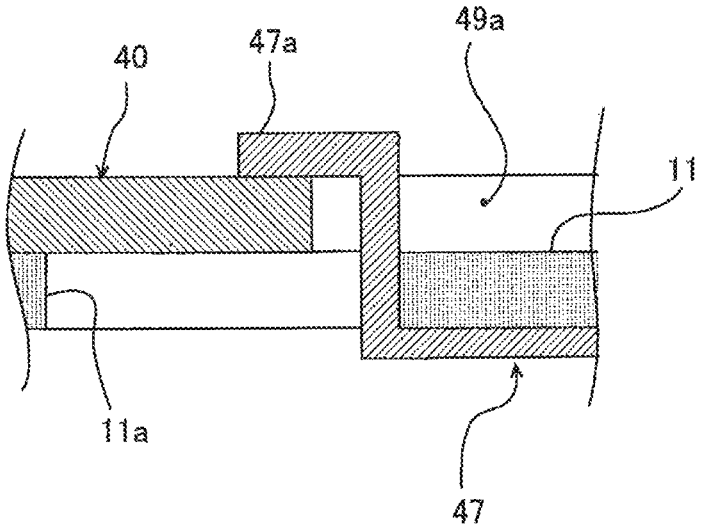
FIG. 18A is an enlarged view illustrating a part A of FIG. 17C.
Figure 18B:
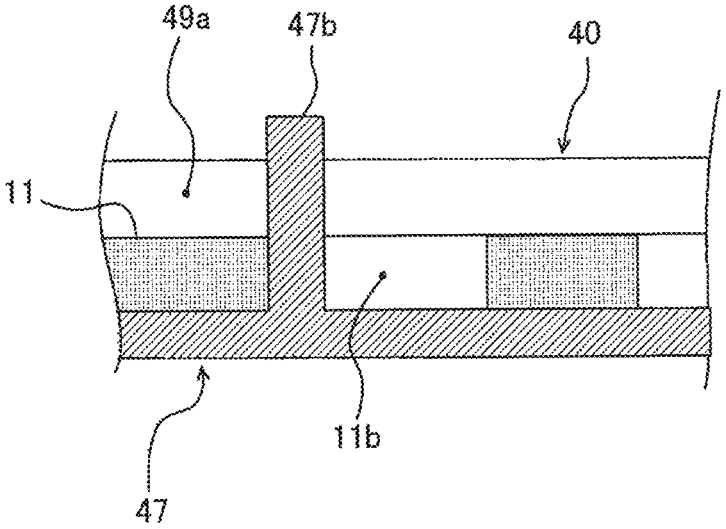
FIG. 18B is an enlarged view illustrating a part B of FIG. 17C.

FIG. 16 is a perspective cross-sectional view illustrating the fixed-movable loading unit 40 viewed from the upstream side in the sheet conveying direction, and FIG. 17 is a view illustrating the fixed-movable loading unit 40 attached to the sheet loading base 11. FIG. 18A is an enlarged view illustrating part A of FIG. 17C, and FIG. 18B is an enlarged view illustrating part B of FIG. 17C. As illustrated in FIG. 16, the fixed-movable loading unit 40 includes a fixing portion 49 on the upstream side in the sheet conveying direction. The fixing portion 49 is configured to fix the fixed-movable loading unit 40 to the sheet loading base 11. The fixing portion 49 is provided with an elongated hole 49*a* extending in the sheet conveying direction.

The fixed-movable loading unit 40 is attached to the sheet loading base 11 using a unit fixing plate 47. A hook-shaped fixing claw 47*a* and a location projection 47*b* are disposed on a downstream end of the unit fixing plate 47 in the sheet conveying direction. First, as illustrated in FIG. 17A, the claw portion 47*a* of the unit fixing plate 47 is inserted into the long hole 49*a* of the fixed-movable loading unit 40 from the lower side of the sheet loading base 11. As illustrated in FIG. 17A, a first hole 11*a* and a second hole 11*b* are formed on the sheet loading base 11, and the fixing claw 47*a* of the unit fixing plate 47 is inserted into a long hole 49*a* through the first hole 11*a*.

Next, the fixing claw 47*a* comes in contact with a downstream end in the sheet conveying direction of the long hole 49*a*. Thereafter, as illustrated in FIGS. 17A and 17B, the unit fixing plate 47 is rotated clockwise with the fixing claw 47*a* as the fulcrum, and the location projection 47*b* of the unit fixing plate 47 passes through the second hole 11*b* of the sheet loading base 11 and the long hole 49*a* of the fixed-movable loading unit 40. The length from the fixing claw 47*a* to the location projection 47*b* is approximately equal to the length from an upstream end in the sheet conveying direction of the first hole 11*a* to a downstream end in the sheet conveying direction of the second hole 11*b*. Accordingly, when the location projection 47*b* passes through the second hole 11*b*, the fixing claw 47*a* comes in contact with the upstream end in the sheet conveying direction of the first hole 11*a*, as illustrated in FIG. 18A, and the location projection 47*b* comes in contact with the upstream end in the sheet conveying direction of the second hole 11*b*, as illustrated in FIG. 18B. As a result, a location of the unit fixing plate 47 is determined in the sheet conveying direction. As illustrated in FIG. 17C, when a screw 49*b* is screwed into a screw hole 47*c* of the unit fixing plate 47, a bottom face of the fixed-movable loading unit 40 is pushed toward the sheet loading base 11 by the fixing claw 47*a* and a head portion of the screw 49*b*. Accordingly, the fixed-movable loading unit 40 is attached to the sheet loading base 11 such that a portion between the first hole 11*a* and the second hole 11*b* of the sheet loading base 11 is interposed between the fixed-movable loading unit 40 and the unit fixing plate 47.

The fixed-movable loading unit 40 is secured to the unit fixing plate 47 located on the sheet loading base 11, such that the fixed-movable loading unit 40 is securely located on the sheet loading base 11. The fixed-movable loading unit 40 is an expansion unit that is used when a sheet bundle having a thickness deviation in the sheet conveying direction is set on the feeding tray 10. Hence, when a sheet bundle having no thickness deviation in the sheet conveying direction is set on the feeding tray 10, the fixed-movable loading unit 40 is removed from a feeding device.

In the present embodiment, the fixed-movable loading unit 40 is attached to the sheet loading base 11 with a single screw. Thus, the fixed-movable loading unit 40 can be easily attached to and detached from the sheet loading base 11. Accordingly, the fixed-movable loading unit 40 can be easily extended to a device having the feeding tray 10 in which the sheet bundle having the thickness deviation in the sheet conveying direction can be set.

Figure 19:
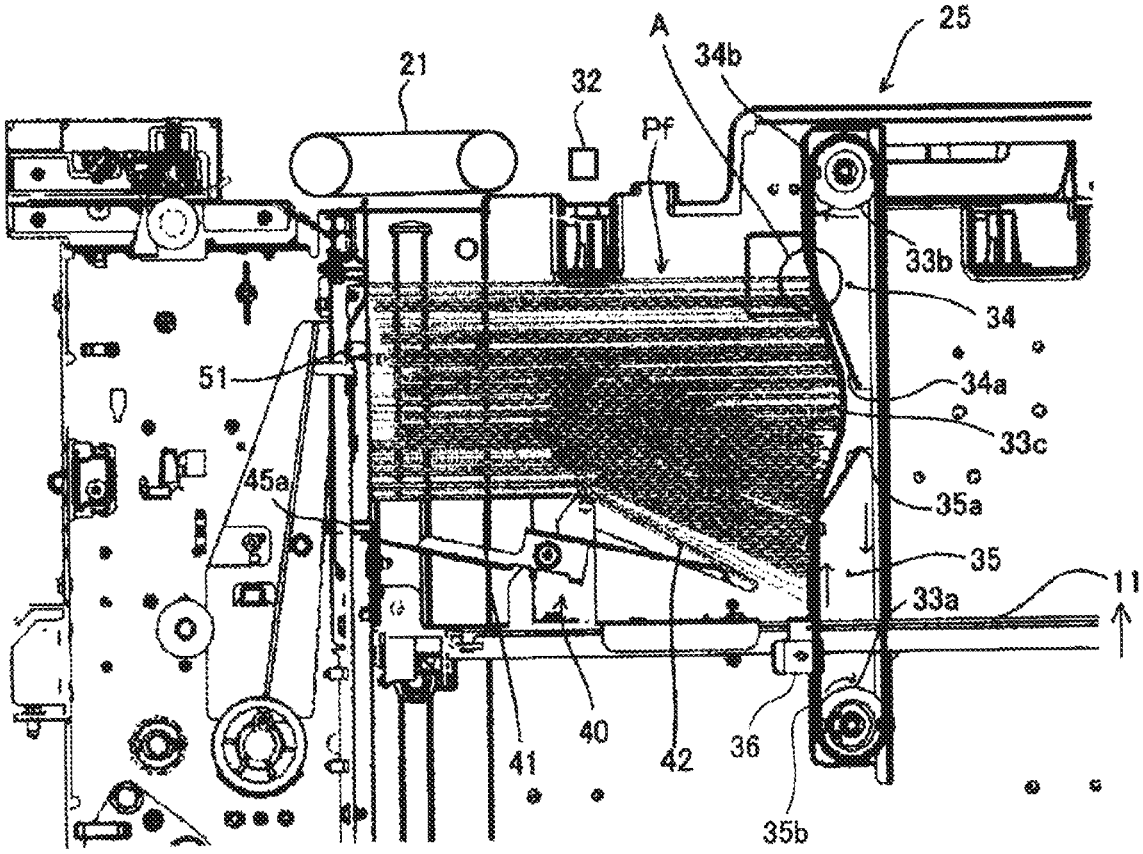
FIG. 19 is a side view illustrating a state in which a sheet bundle composed of sheets having a thickness deviation in the sheet conveying direction is set.
Figure 20B:
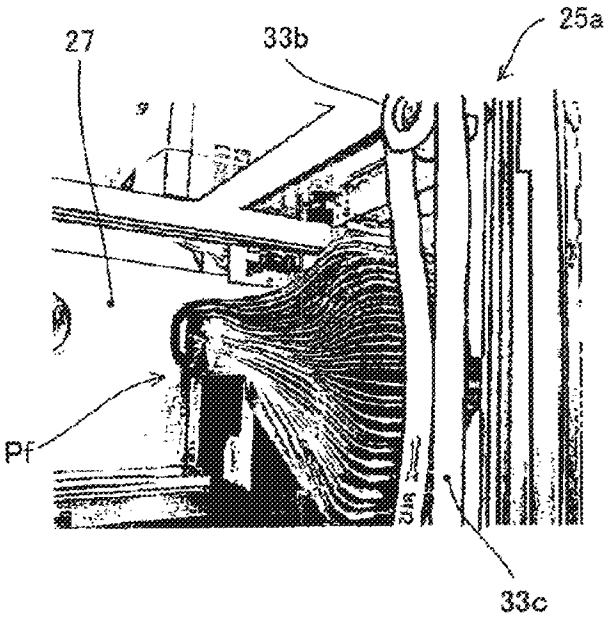
FIGS. 20A to 20D are perspective views illustrating the feeding tray viewed from different directions on which a sheet bundle having a thickness deviation in the sheet conveying direction is set.
Figure 20A:
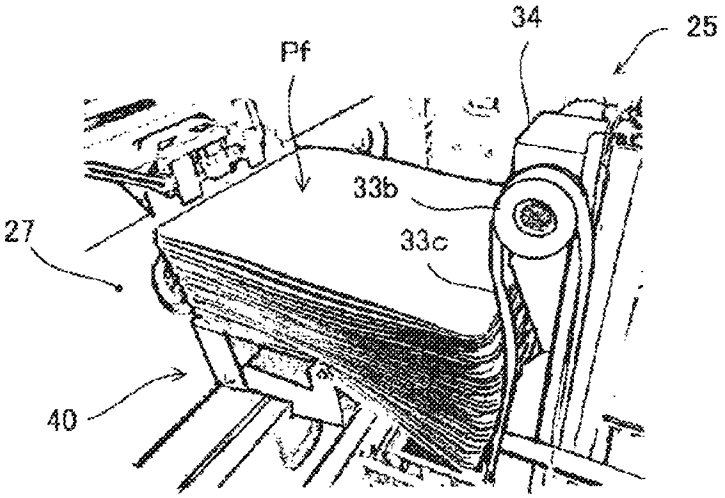
Figure 20D:
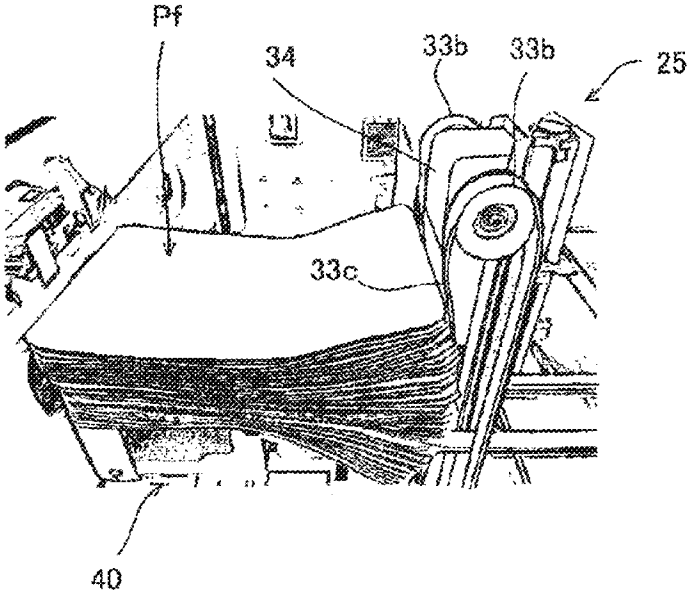
Figure 20C:
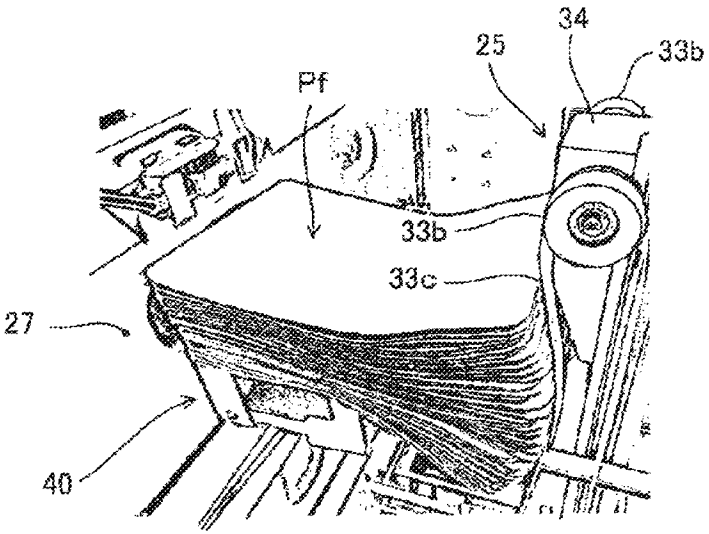

FIG. 19 is a side view illustrating a state in which a sheet bundle Pf having a thickness deviation in the sheet conveying direction is set, and FIGS. 20A to 20D are perspective views each illustrating the feeding tray in which the sheet bundle Pf is set in a different direction.

According to the present embodiment, when the number of sheets of the sheet bundle Pf is large, and the fan-shape spread at the rear end side of the sheet bundle Pf is large, the sheet loading base 11 is located at a lower position, and the movable protrusion 45*a* of the loading unit is separated from the first protrusion 51, as illustrated in FIG. 19. Accordingly, the movable base 42 is tilted in this case. Accordingly, as illustrated in FIG. 19 and FIGS. 20A to 20D, the rear end side of the lower part of the sheet bundle is tilted along the tilting of the movable base 42. As a result, the fan-shape spread of the upper part of the sheet bundle is reduced compared to the related art example illustrated in FIG. 6. Accordingly, it is possible to prevent a situation where the end sensor 32 detects the presence of the sheet, but the sheet detecting sensor 31 detects the absence of sheet, and the lifting control can be performed efficiently.

In addition, since curvature at the rear side of the upper part of the sheet bundle can be reduced, the restoring force acting downward to the front end side of the sheet can be reduced, and the top sheet can be floated and suctioned onto the suction belt 21 effectively.

According to the present embodiment, the belt controllers 33 are disposed on the end fence 25. Hence, even when the rear end positions of the sheets of the sheet bundle vary in a vertical direction due to the fan-shape spread of the rear side of the sheet bundle, the belt members 33*c* acting as elastic deforming members of the belt controllers 33 elastically deform along a fan-shape spread of the rear side of the sheet bundle, thereby allowing the end fence 25 to come in contact with the rear end of the sheet bundle without gaps.

According to the present embodiment, since the fan-shape spread of the rear side of the sheet bundle cannot be completely absorbed by the tilting of the movable base 42, the rear end side of the sheet bundle set on the feeding tray 10 is shaped so that the upper part and the lower part of the sheet bundle spread, respectively, and the central part of the sheet bundle is positioned at the most upstream side in the sheet conveying direction, as illustrated in FIGS. 20A to 20D.

According to the present embodiment, the restriction members that are not elastically deformable are respectively disposed on an upper part and a lower part of the end fence 25, so that the restriction members protrude from the belt members 33*c*, and the central portions of the belt members 33*c* protrude from the restriction members. Thus, the rear end of the vertically central part of the sheet bundle at the most upstream side in the sheet conveying direction comes in contact with the belt members 33*c*, and the belt members 33*c* elastically deform to be depressed toward the upstream side in the sheet conveying direction. This configuration allows the end fence 25 to move toward the downstream side in the sheet conveying direction even after the rear end of the vertically central part of the sheet bundle comes in contact with the belt members 33*c*. Thus, the contact surface 34*b* of the upper restriction member 34 is in contact with the rear end of the upper part of the sheet bundle, and the contact surface 35*b* of the lower restriction member 35 is in contact with the rear end of the lower part of the sheet bundle.

Further, since the tension of the belt members 33*c* of the pair of belt controllers 33 is the same, the elastic forces applied from the belt members 33*c* to the sheet bundle when the end fence 25 is in contact with the sheet bundle can be made the same, and the bending of the sheets can be reduced.

Further, the tension of the belt members 33*c* is configured to be adjustable in this configuration. Hence, when the sheets having weak resilience are loaded, the tension of the belt members 33*c* can be reduced, and the elastic force of the belt members 33*c* can prevent the sheets from being bent.

According to the present embodiment, the belt members 33*c* are each supported on the stretching rollers 33*a* and 33*b* for endless movement. Accordingly, when the sheet loading base 11 is raised from a position illustrated in FIG. 19 to perform feeding of sheets, the belt members 33*c* secured to the sheet loading base 11 by belt fixing members 36 rotate clockwise as indicated by arrows in FIG. 19. This allows the sheet bundle to move up smoothly.

According to the present embodiment, since vertically central portions of the belt members 33*c* are depressed toward the upstream side in the sheet conveying direction, the upper sides of the belt members 33*c* are inclined toward the downstream side in the sheet conveying direction, acting as resistance against rising of the sheet bundle. Furthermore, the belt members 33*c* are a rubber material having a high sliding resistance against a sheet. Accordingly, in a case where the belt members 33*c* are configured so as not to move endlessly, a failure such as the rear ends of the sheets being bent downward may occur when the sheet bundle rises. Accordingly, as in the present embodiment, the belt members 33*c* are configured to move endlessly, so that the belt members 33*c* endlessly move as the sheet bundle rises. This configuration effectively prevents a failure such as the rear ends of the sheets being bent downward.

Further, according to the present embodiment, since the surface of the belt member 33*c* has an uneven shape, the belt member 33*c* can endlessly move as the sheet bundle rises without failure, thereby smoothly raising the sheet bundle.

According to the present embodiment, the contact surface 34*b* of the upper restriction member 34 is positioned closer to the sheet bundle than the belt member 33*c*. Accordingly, contact of the rear end of the sheet bundle switches from the belt member 33*c* to the upper restriction member 34 as the sheet bundle rises.

According to the present embodiment, the upper restriction member 34 has a guiding slope 34*a*. The guiding slope 34*a* is configured such that a lower end of the guiding slope 34*a* is closer to the upstream side in the sheet conveying direction than an upper end of the guiding slope 34*a*.

Figure 21:
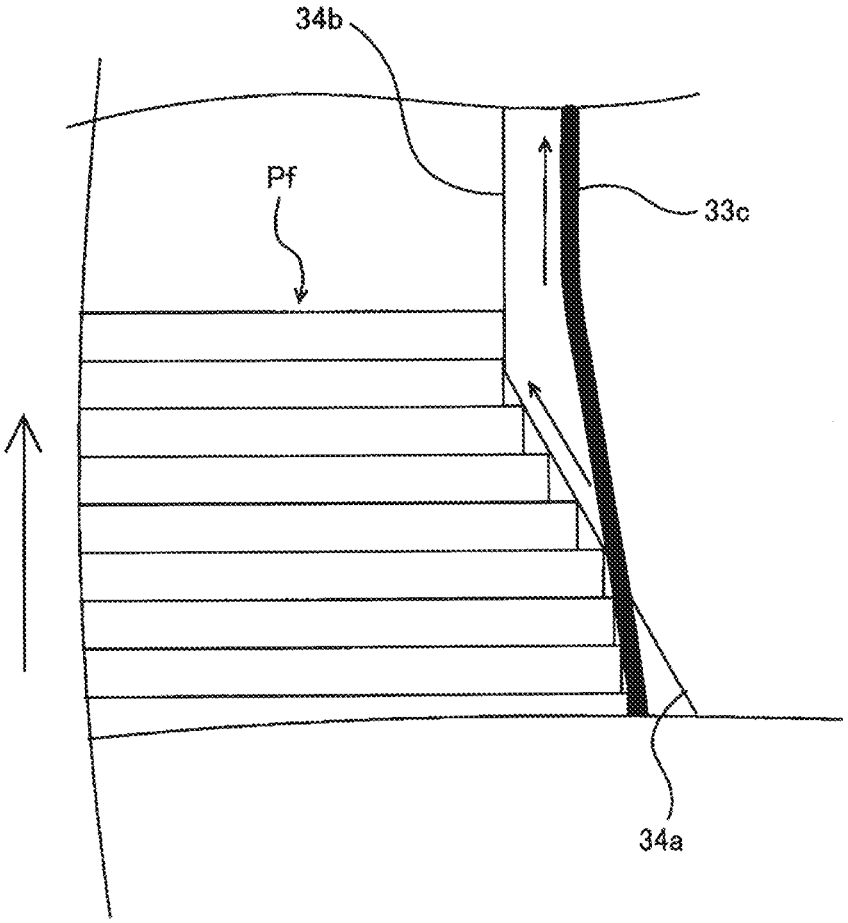
FIG. 21 is an enlarged view illustrating a part A of FIG. 19.

FIG. 21 is an enlarged view illustrating a portion A of FIG. 19. As illustrated in FIG. 21, each of the upper restriction members 34 has a guiding slope 34*a* to smoothly transfer the sheets from the belt member 33*c* to the upper restriction member 34. Accordingly, the rear ends of the sheets can be prevented from being caught by the upper restriction member 34 when the sheets are transferred from the belt member 33*c* to the upper restriction member 34. Thus, a failure such as the rear ends of the sheets being bent downward or the like may be prevented.

Further, the lower restriction member 35 in contact with the rear end of the sheet bundle is also switched to the belt member 33*c* as the sheet bundle rises. According to the present embodiment, the lower restriction member 35 has a guiding slope 35*a*. The guiding slope 35*a* is configured such that an upper end of the guiding slope 35*a* is closer toward the upstream side in the sheet conveying direction than the lower end of the guiding slope 35*a*. According to this configuration, the sheets can be efficiently transferred from the lower restriction member 35 to the belt members 33*c*.

Then, when the top sheet of the sheet bundle reaches the feeding position, and the rising of the sheet bundle stops, the rear end of the upper part of the sheet bundle is restricted by a contact surface 34*b* of the upper restriction member 34, which is not elastically deformable. Accordingly, the rear end positions of the sheets can be reliably restricted by the contact surface 34*b*, so that the floating top sheet can be prevented from being retracted, and the front end of the second sheet and the top sheet can be prevented from being suctioned onto the suction belt, thereby preventing the duplicated feeding, as described above.

The rear end of the lower part of the sheet bundle is also restricted by a contact surface 35*b* of the lower restriction member 35, which is not elastically deformable. As noted above, the rear end of the lower part of the sheet bundle Pf is inclined downward along the tilting of the movable base 42. Accordingly, the lower part of the sheet bundle may be lowered with self-weight; however, such lowering of the lower part of the sheet bundle can be firmly restricted by the contact surface 35*b* of the lower restriction member 35.

As described above, the upper and lower ends of the end fence 25 are provided with the upper and lower restriction members 34 and 35 to firmly restrict the rear ends of the upper part and the lower parts of the sheet bundle. Hence, the tension of the belt members 33*c* in contact with the vertically central part of the sheet bundle can be easily reduced so that the belt members 33*c* are elastically deformable. This enables efficient feeding by restricting the rear end position of the sheet bundle and by deforming of the belt members 33*c* along the fan-shape spread of the rear end of the sheet bundle.

In addition, when the number of sheets of the sheet bundle Pf is reduced as the feeding of the sheets progresses, the fan-shape spread of the rear side of the sheet bundle decreases. Thus, if the tilting of the movable base 42 is still the same as an initial tilting, and the number of sheets of the sheet bundle is reduced, the rear side of the top sheet of the sheet bundle is lowered along the tilting of the movable base 42. As a result, when the top sheet is floated, the top sheet is likely to be retracted, and duplicated feeding may occur.

However, according to the present embodiment, as described above, the movable protrusion 45*a* comes in contact with the first protrusion 51 to rotate the movable base 42, so that the tilting of the movable base 42 becomes gradual. Accordingly, the tilting of the movable base 42 can be gradually reduced in accordance with a decrease in the fan-shape spread of the rear side of the sheet bundle due to a decrease in the number of sheets of the sheet bundle. Accordingly, the rear side of the top sheet of the sheet bundle can be prevented from being lowered, and the top sheet can be prevented from being retracted when the sheet is floated. This prevents duplicated feeding from occurring.

As described above, according to the present embodiment, it is possible to feed a sheet bundle composed of sheets each having a large thickness deviation in the sheet conveying direction, such as a bag type sheet. Such a bag type sheet has a zipper at an opening on one side in the sheet conveying direction of the sheet, and a large fan-shape spread at a rear side that is the other side in the sheet conveying direction.

Figure 22:
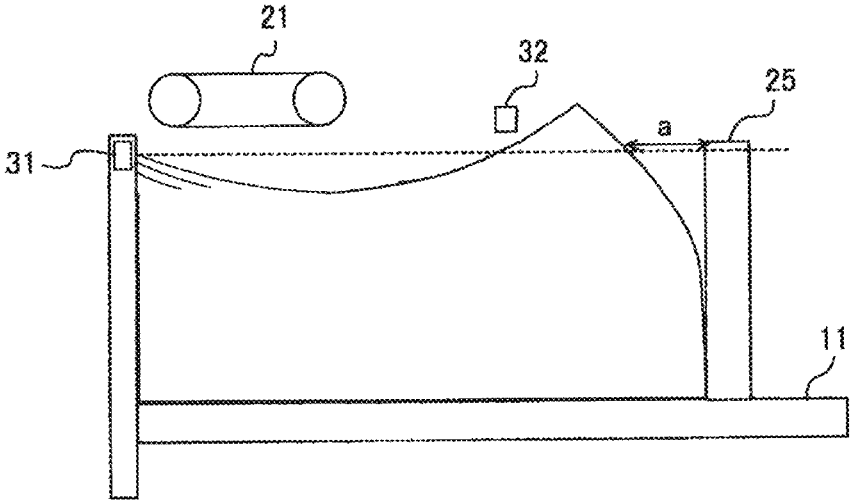
FIG. 22 is a schematic view illustrating a sheet bundle with two ends spreading in a fan-shape.

An example of a sheet to be fed may be a bag type sheet having a zipper on an opening side and a bottom side folded inward such that the bottom side and opening side are thicker than the central part of the bag type sheet. This bag type of a bundle of sheets each having the opening side and the bottom side thicker than the center thereof exhibits a fan-shape spread on thicker opening and bottom sides. As described above, when a sheet bundle with thicker opening side and thicker bottom side spreading in a fan-shape manner is set in the feeding device, as illustrated in FIG. 22, the front end side and the rear end side of the upper part of the sheet bundle are higher than the center thereof. Further, even when the fixed-movable loading unit 40 is installed on the sheet loading base 11, and a sheet bundle having a bottom side and an opening side thicker than the center thereof is set on the fixed-movable loading unit 40, the front end side of the sheet bundle remains higher than the others.

As described above, when the front end side of the sheet bundle is high, the sheet detecting sensor 31 detects the sheet, but the end sensor 32 does not detect the sheet. Thus, despite the sheet bundle being set, the end sensor 32 is likely to determine the sheet bundle to be out-of-sheet, and perform control to instruct a user to set a sheet bundle.

In addition, since the front end of the sheet is curved, a restoring force acts downward on the front end of the sheet. As a result, the top sheet of the sheet bundle is difficult to float, and the top sheet may not be suctioned onto the suction belt 21.

Thus, according to the present embodiment, a plurality of loading units having configurations differing from each other can be selectively attached to the sheet loading base 11. According to this configuration, when a sheet bundle with two ends spreading in a fan-shape in the conveying direction is set to be fed, the fixed-movable loading unit 40 capable of handling a sheet bundle having a fan-shape spread only on the upstream side in the conveying direction can be changed to another loading unit (later-described movable-movable loading unit 140) capable of handling a sheet bundle having a fan-shape spread on two ends in the conveying direction. The following describes a movable-movable loading unit having a sheet loading surface capable of handling a sheet bundle with two ends spreading in a fan-shape in the conveying direction. Such a sheet loading surface has an inverted V-shape with the center thereof being higher than two ends thereof.

Figure 23A:
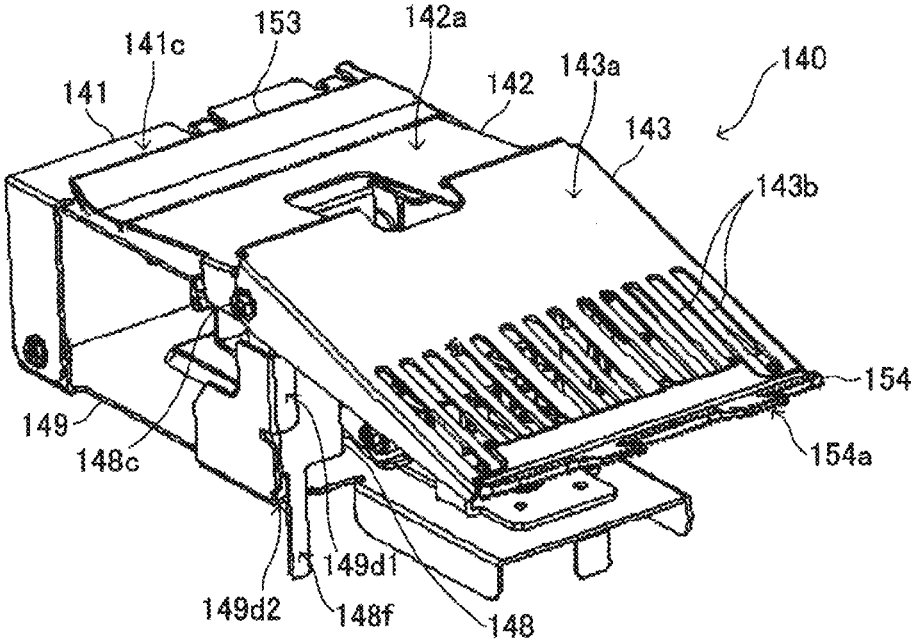
FIGS. 23A and 23B are perspective views illustrating a movable-movable loading unit (i.e. a unit with two movable bases).
Figure 23B:
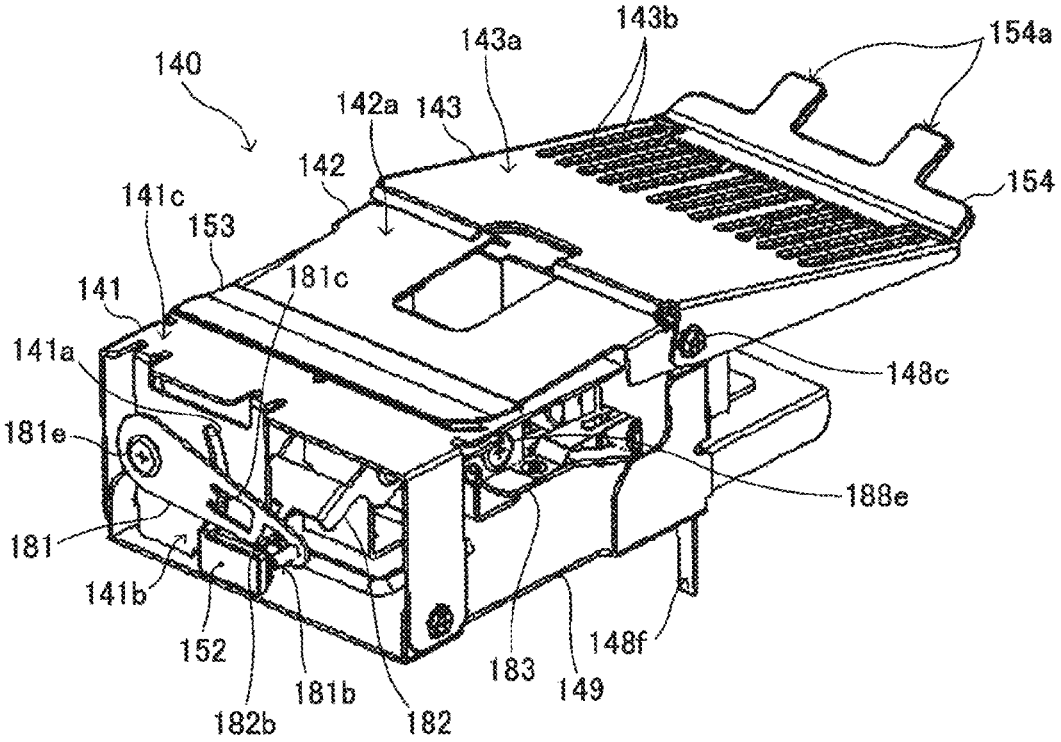
Figure 24:
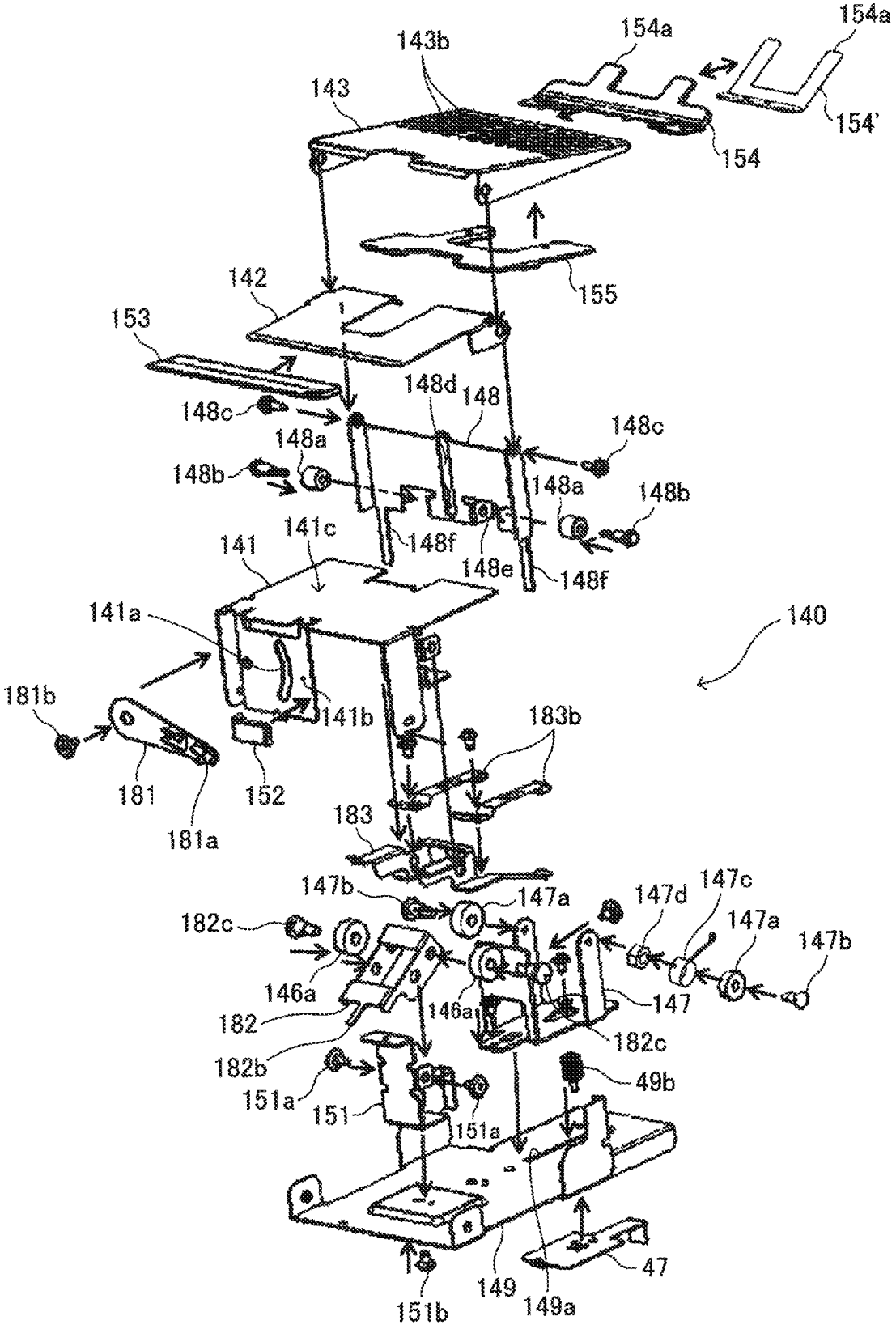
FIG. 24 is an exploded perspective view illustrating the movable-movable loading unit.
Figure 25:
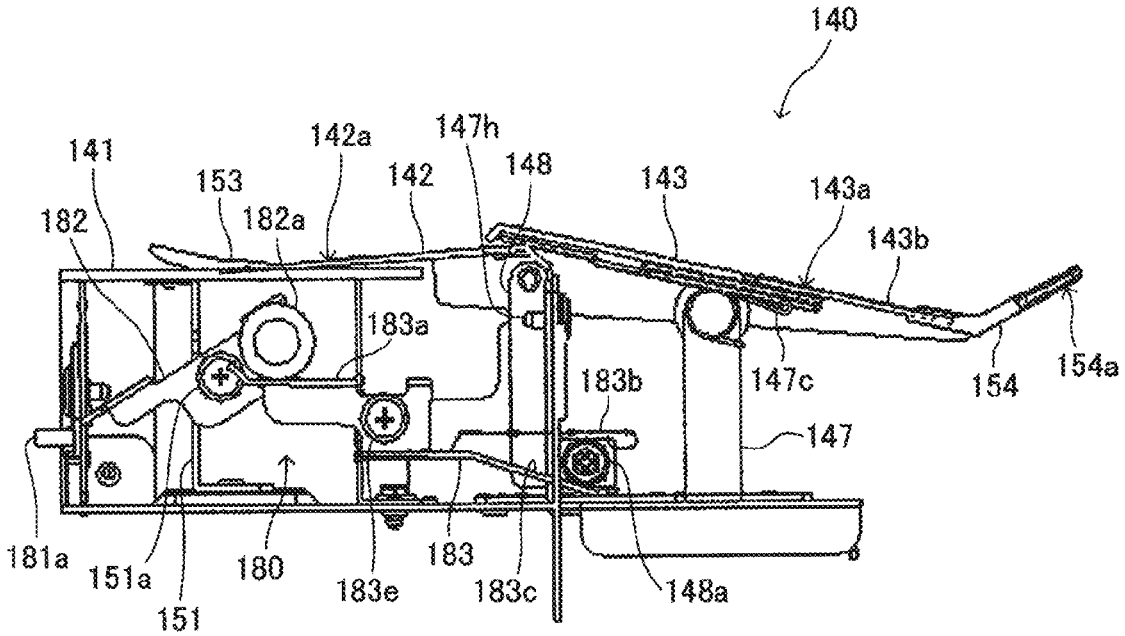
FIG. 25 is a cross-sectional view illustrating the movable-movable loading unit.

FIGS. 23A and 23B are perspective views illustrating a movable-movable loading unit 140. FIG. 23A is a perspective view illustrating the movable-movable loading unit 140 viewed from an upstream side in the conveying direction, and FIG. 23B is a view illustrating the movable-movable loading unit 140 viewed from a downstream side in the conveying direction. FIG. 24 is an exploded perspective view illustrating the movable-movable loading unit 140, and FIG. 25 is a cross-sectional view illustrating the movable-movable loading unit 140.

The movable-movable loading unit 140 includes a fixing base 141, a first movable base 142, and a second movable base 143. In this configuration, a front end side in the conveying direction of the sheet bundle is loaded on the first movable base 142, and a rear end side in the conveying direction of the sheet bundle is loaded on the second movable base 143. The fixing base 141 is screwed onto a base member 149. The fixing base 141 includes a supporting surface 141*c* configured to support a downstream side in the conveying direction of the first movable base 142 and a front end side of the sheet bundle, and a facing surface 141*b* configured to face the front fence 27. As can be seen from a comparison between FIG. 23B and FIG. 10, the facing surface 141*b* of the movable-movable loading unit 140 are disposed on an opposite side in the sheet width direction, compared to the facing surface 41*b* of the fixed-movable loading unit 40. The facing surface 141*b* is provided with a restriction hole 141*a* configured to restrict the rotation range of the first rotating member 181, as in the facing surface 41*b* of the fixed-movable loading unit 40.

The first movable base 142 and the second movable base 143 are rotatably attached to an upper part of the vertically movable base lifting member 148 with stepped screws 148*c*, where the base lifting member 148 is attached in a vertically movable manner. The base lifting member 148 moves up and down (moves vertically) by a link mechanism 180. The link mechanism 180 includes first, second and third rotating members 181, 182, and 183.

A front-end scooping member 153 is disposed on a tip end of the first movable base 142. The front-end scooping member 153 is a slope member made of resin, which is more slidable than the first movable base 142 made of metal. The front-end scooping member 153 has a slope inclined with respect to the first sheet loading surface 142*a* of the first movable base 142.

A plurality of slots 143*b* extending in the conveying direction is disposed on an upstream side in the conveying direction of the second movable base 143. As illustrated in FIG. 24, a spacer member 155 acting as a weight member is attached to a rear side (a back side of a sheet loading surface) of the second movable base 143 at the downstream side in the conveying direction.

A rear-end supporting member 154 is attached to an upstream end in the conveying direction of the second movable base 143. The rear-end supporting member 154 is configured to support a rear end of the sheet bundle loaded on the movable-movable loading unit 140. The rear-end supporting member 154 is provided with a pair of protruding portions 154*a*. These protruding portions 154*a* are disposed so as not to face the end fence 25 such that the end fence 25 is interposed between a pair of protruding portions 154*a*, and the protruding portions 154*a*.

In order to handle a sheet bundle having a short length in the conveying direction, the end fence 25 is interposed between the pair of protruding portions 154*a*. This configuration allows the end fence 25 to abut against the rear end of the sheet bundle to restrict the rear end of the sheet bundle. Thus, the movable-movable loading unit 140 is capable of handling a plurality of sheets having different lengths in the conveying direction, thereby reducing costs compared to the case where a plurality of movable-movable loading units is disposed according to different lengths of sheets. In addition, replacement of a loading unit is not required every time a sheet bundle having a different length in the conveying direction is to be loaded, and the convenience can be improved compared to the case where a plurality of movable-movable loading units is disposed according to different lengths of sheets.

Further, the rear-end supporting member 154 is detachably configured with respect to the second movable base 143. When a long sheet bundle in the conveying direction is loaded, the rear-end supporting member 154 is replaceable with a rear-end supporting member 154' having the length of the protruding portion 154*a* illustrated in FIG. 24. Accordingly, even when a long sheet bundle in the conveying direction is loaded, the rear end of the long sheet bundle in the conveying direction can be supported by the rear-end supporting member 154'. This configuration allows for a variety of sheet bundles having different lengths at lower cost compared to the case where a plurality of movable-movable loading units is disposed according to the length of the sheet bundle.

The rear-end supporting member 154 supports the rear end of the sheet bundle to prevent the rear end side of the sheet bundle from being deflected downward. When the rear end of the sheet bundle is not supported, and the rear end side of the sheet bundle protrudes from the second movable base 143, the rear end side of the sheet bundle may deflect downward. When the rear end side of the sheet bundle deflects downward, the rear end side of the sheet bundle cannot be restricted by the end fence 25, and the sheets at the lower side of the sheet bundle may slide downward in the conveying direction. Further, when a sheet from the sheet bundle with the rear end side deflecting downward is fed, the sheet being fed is caught due to a deflected rear end side of the sheet, resulting in defective sheet feeding. Thus, according to the configuration of the present embodiment, the rear-end supporting member 154 is configured to support the rear end of the sheet bundle so as to prevent the rear end side of the sheet bundle from deflecting downward. Accordingly, the end fence 25 can efficiently restrict the rear end side of the sheet bundle, thereby preventing the sheets at the lower side of the sheet bundle from sliding downward at an upstream side in the conveying direction. In addition, according to the configuration of the present embodiment, occurrence of the defective feeding can also be prevented.

The base lifting member 148 includes guide portions 148*f* extending downward that are disposed on two ends in a width direction, and a guide hole 148*d* extending vertically that is disposed at the center in the width direction. A pair of roller attaching portions 148*e*, on which connecting rollers 148*a* are attached, are disposed at a lower middle end of the base lifting member 148 in the width direction. The connecting rollers 148*a* are rotating members connected to the third rotating member 183. The connecting rollers 148*a* are rotatably attached to the roller attaching portions 148*e* with a stepped screw 148*b*.

The base member 149 includes first guide portions 149*d*1 and second guide portions 149*d*2. The first guide portions 149*d*1 and the second guide portions 149*d*2 are configured to guide the base lifting member 148 (see FIGS. 23A and 23B). The first guide portions 149*d*1 face an end portion in the width direction of the base lifting member 148 from the upstream side in the conveying direction. The second guide portions 149*d*2 face the guide portions 148*f* of the base lifting member 148 from a downstream side in the conveying direction. A stepped screw 147*h* attached to a base supporting member 147 penetrates a guide hole 148*d* of the base lifting member 148. The base lifting member 148 is guided by the first guide portions 149*d*1, the second guide portions 149*d*2, and a stepped screw 147*h* such that the base lifting member 148 moves up and down (in a vertical direction).

Figure 26:
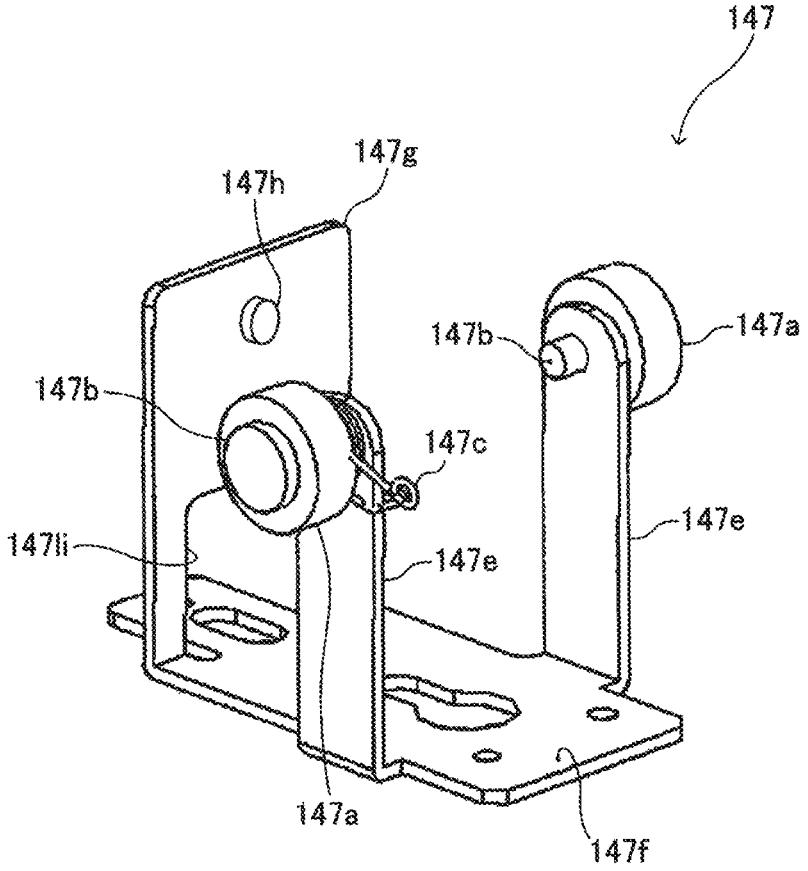
FIG. 26 is a perspective view illustrating a supporting member of a movable-movable loading unit.

As illustrated in FIGS. 24 and 25, the movable-movable loading unit 140 includes the base supporting member 147 configured to support a second movable base 143. FIG. 26 is a perspective view illustrating the base supporting member 147. The base supporting member 147 includes supporting rollers 147*a* acting as rotating members that contact a rear surface of the second movable base 143 to support the second movable base 143. The supporting rollers 147*a* are rotatably attached to respective upper ends of a pair of roller supporting portions 147*e* with stepped screws 147*b*, where the pair of roller supporting portions 147*e* extend upward from the base portion 147*f*.

A torsion spring 147*c* acting as a preloading member is retained by the stepped screw 147*b* via a hexagonal nut 147*d* (FIG. 24), where the stepped screw 147*b* rotatably attaches the supporting roller 147*a* to the roller supporting portion 147*e*. One end of the torsion spring 147*c* is secured to the roller supporting portion 147*e* with tape or the like, and the other end of the torsion spring 147*c* is in contact with the rear surface of the second movable base 143 to preload the second movable base 143 in an upward direction, as illustrated in FIG. 25.

Further, the base supporting member 147 includes a facing portion 147*g* facing the base lifting member 148 from the upstream side in the conveying direction. A stepped screw 147*h*, which passes through the guide hole 148*d* of the base lifting member 148, is fastened to the facing portion 147*g*. The facing portion 147*g* is provided with a through hole 147*i* through which the roller attaching portions 148*e* of the base lifting member 148 passes.

A plurality of slots 143*b* is formed on a more upstream side in the conveying direction of the second movable base 143 than a second movable base supporting position at which the supporting rollers 147*a* of the supporting member 147 are in contact with the second movable base 143. Thus, the weight of the more upstream side in the conveying direction of the second movable base 143 than the second movable base supporting position is made lighter. As described above, a spacer member 155 is attached to a rear surface of a more downstream side in the conveying direction of the second movable base 143 than the second movable base supporting position. Thus, the more downstream side in the conveying direction of the second movable base 143 is made heavier. These configurations allow the center of gravity of the second movable base 143 to be located at a more downstream side in the conveying direction than the second movable base supporting position at which the second movable base 143 is supported by the base supporting member 147. When the center of gravity of the second movable base 143 is located at a more downstream side in the conveying direction than the second movable base supporting position at which the second movable base 143 is supported by the base supporting member 147, the second movable base 143 rotates about the second movable base supporting position as the fulcrum by the self-weight of the second movable base 143 to lower the downstream end in the conveying direction of the second movable base 143 (counterclockwise rotation illustrated in FIGS. 23A and 23B).

Further, the torsion spring 147*c* disposed on the supporting member 147 preloads the second movable base 143 in an upward direction at the more upstream side in the conveying direction than the second movable base supporting position at which the second movable base 143 is supported by the base supporting member 147. This configuration assists rotation of the second movable base 143 using the second movable base supporting position as the fulcrum by self-weight of the second movable base 143 so as to lower the downstream end in the conveying direction of the second movable base 143. A sliding sheet is attached to a contact portion of the second movable base 143 with the torsion spring 147*c*.

Figure 27:
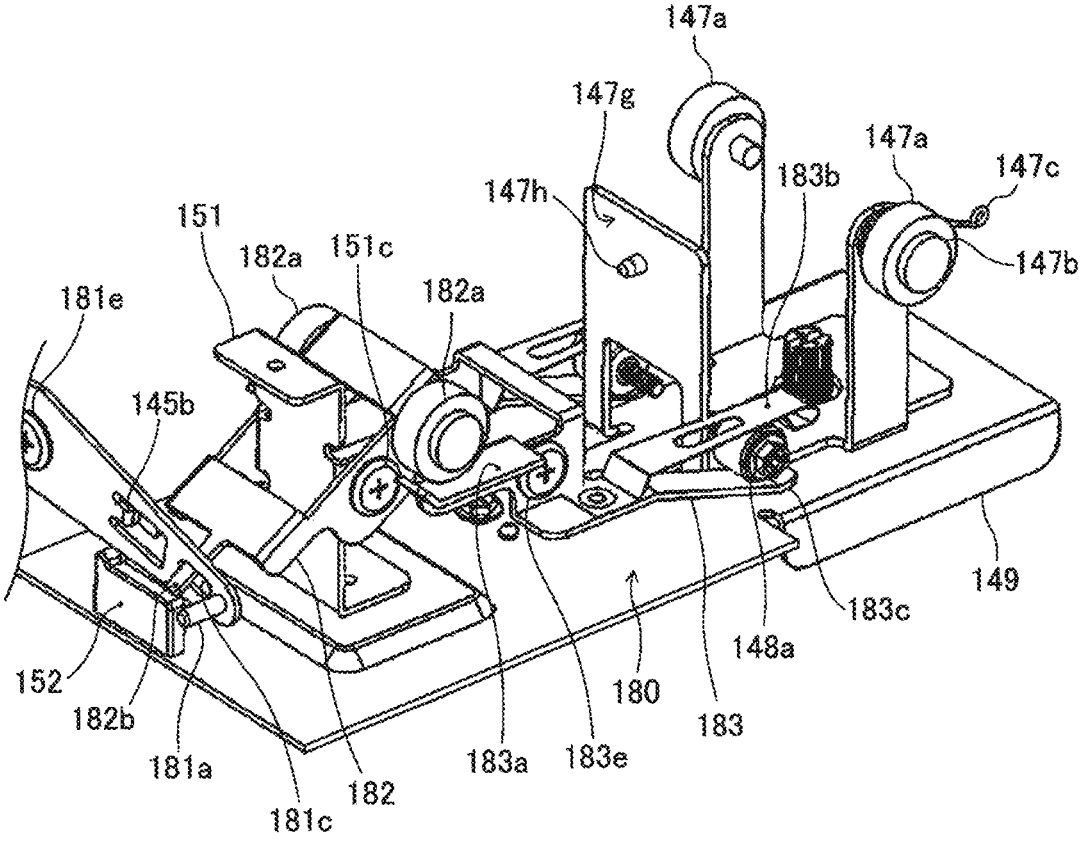
FIG. 27 is a schematic perspective view illustrating a link mechanism of the movable-movable loading unit.

FIG. 27 is a schematic perspective view illustrating a link mechanism 180. The first rotating member 181 of the link mechanism 180 that moves the base lifting member 148 is in the same shape as the first rotating member 45 of the fixed-movable loading unit 40 described above. Specifically, one end of the first rotating member 181 is rotatably attached to the facing surface 141*b* of the fixing base 141 with a stepped screw 181*e*, and a movable protrusion 181*a* is disposed on the other end of the first rotating member 181. Further, a through-hole portion 181*c* through which the coupling portion 182*b* of the second rotating member 182 passes is provided adjacent the movable protrusion 181*a*. The first rotating member 181 has a restriction protrusion 181*b* that enters the restriction hole 141*a* provided on the facing surface 141*b*.

A link stopper 152 configured to restrict the rotation of the first rotating member 181 is attached to the fixing base 141. Thus, the movable-movable loading unit 140, as well as the fixed-movable loading unit 40, restricts the rotation range of the first rotating member 181 by less than 90 degrees.

In the movable-movable loading unit 140 in an initial state, an end of the first rotating member 181 near the movable protrusion 181*a* is positioned lower than the other end of the first rotating member 181, whereas in the fixed-movable loading unit 40 in an initial state, an end of the first rotating member 45 near the movable protrusion 45*a* is positioned higher than the other end of the first rotating member 45 as illustrated in FIG. 10. The movable protrusion 181*a* of the movable-movable loading unit 140 is reversely oriented in a width direction compared to the movable protrusion 45*a* of the fixed-movable loading unit 40 in a width direction.

The second rotating member 182 of the link mechanism 180 is rotatably attached to a link supporting member 151 secured to the base member 149 with stepped screws 151*c*. A coupling portion 182*b* is provided at a downstream end in the conveying direction of the second rotating member 182, and passes through a through hole 181*c* of the first rotating member 181. The upstream end in the conveying direction of the second rotating member 182 is provided with link rollers 182*a* as a pair of rotating members that come in contact with first roller contact portions 183*a* as connected portions of the third rotating member 183. The link rollers 182*a* are rotatably attached to the second rotating member 182 with stepped screws 182*c*.

The third rotating member 183 of the link mechanism 180 is rotatably attached to the fixing base 141 with stepped screws 183*e*.

Figure 28:
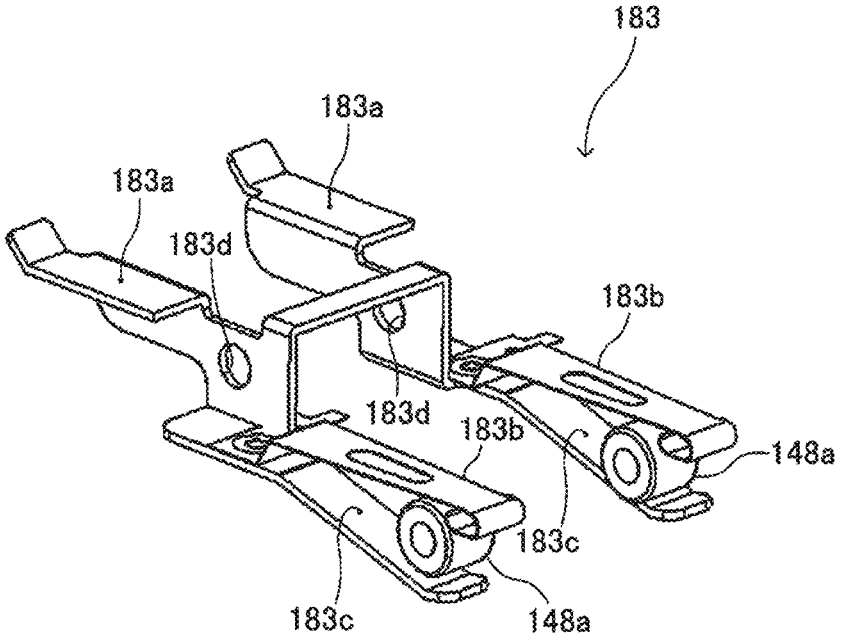
FIG. 28 is a perspective view illustrating a third rotating member of the link mechanism of the movable-movable loading unit.

FIG. 28 is a perspective view illustrating the third rotating member 183 of a link mechanism 180. The third rotating member 183 has a pair of the first roller contact portions 183*a* touched by the link rollers 182*a*, and a pair of supporting holes 183*d* through which the stepped screws 183*e* pass, so that the stepped screws 183*e* are rotatably supported by the pair of supporting holes 183*d*. The third rotating member 183 has a pair of the second roller contact portions 183*c* as connected portions touched by the connecting rollers 148*a* of the base lifting member 148. Leaf spring members 183*b* acting as pressing members are attached to the third rotating member 183, and the connecting rollers 148*a* are interposed between the second roller contact portions 183*c* and the leaf spring members 183*b* in the vertical direction.

The supporting holes 183*d* are disposed closer to the first roller contact portions 183*a* than is the central position in the conveying direction, and the second roller contact portions 183*c* are disposed lower than the first roller contact portions 183*a* such that the center of gravity of the third rotating member 183 is closer to the second roller contact portions 183*c* than are the supporting holes 183*d*, which act as the fulcrum of rotation of the third rotating member 183. Accordingly, the third rotating member 183 is rotated by the self-weight of the third rotating member 183 in a direction of lifting the link rollers 182*a*.

The second roller contact portions 183*c* of the third rotating member 183 are subjected to the self-weight of the base lifting member 148. Further, as described above, a depressing force is applied to the base lifting member 148 from the second movable base 143, and this depressing force is applied to the second roller contact portions 183*c*. Additionally, as described above, the third rotating member 183 is rotated by the self-weight of the third rotating member 183 in the direction of lifting the link rollers 182*a*. As a result, the third rotating member 183 is rotated clockwise, the link rollers 182*a* are lifted, the connection rollers 148*a* are lowered, and the base lifting member 148 is positioned at a lowered position.

The distance from the fulcrum (stepped screw 183*e*) of rotation of the third rotating member 183 to a contact portion of the third rotating member 183 in contact with the link roller 182*a* is made shorter than the distance from the fulcrum (stepped screw 183*e*) of rotation of the third rotating member 183 to a contact portion of the third rotating member 183 in contact with the connecting rollers 148*a*. According to this configuration, the force (the self-weight of the base lifting member 148) applied to the second roller contact portions 183*c* from the connection rollers 148*a* can be amplified, so that the link rollers 182*a* can be efficiently lifted. Note that the force applied to the second roller contact portions 183*c* from the connection rollers 148*a* acts on the contact portions between the link rollers 182*a* and the first roller contact portions 183*a*.

As described above, the connecting rollers 148*a* are interposed between the second roller contact portions 183*c* and the leaf spring members 183*b* in the vertical direction. Accordingly, even when the base lifting member 148 is caught by the first guide portions 149*d*1 or the second guide portions 149*d*2 of the base member 149 when the third rotating member 183 rotates to lift the link rollers 182*a*, the base lifting member 148 can be lowered by the preload of the leaf spring members 183*b* that touch the connecting rollers 148*a* from above.

As the link rollers 182*a* of the second rotating member 182 are lifted, the second rotating member 182 rotates counterclockwise to push down the first rotating member 181. This causes the first rotating member 181 to come in contact with the link stopper 152 such that the movable protrusion 181*a* is positioned downward in the initial state.

Figure 29A:
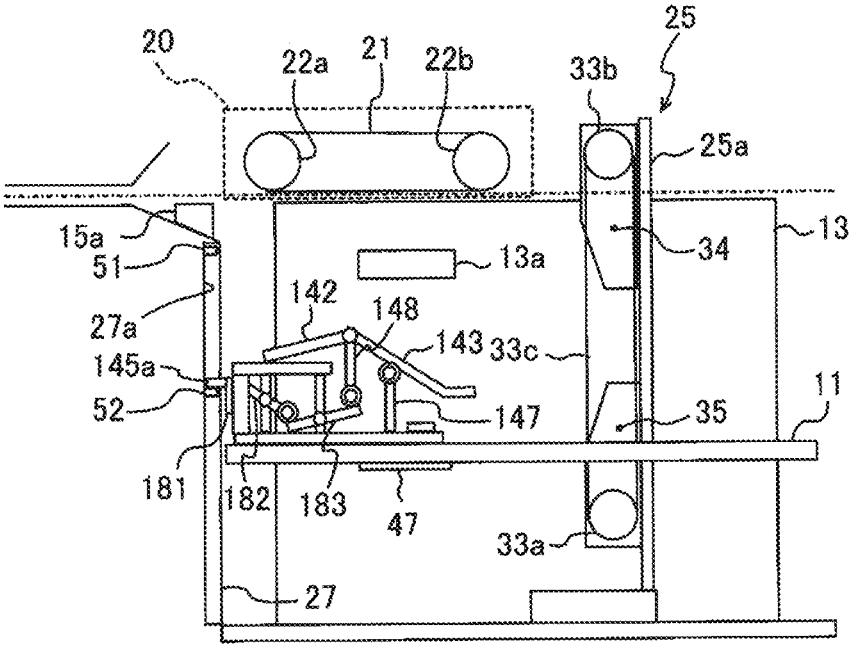
FIGS. 29A and 29B are schematic configuration views illustrating a feeding device with the movable-movable loading unit.
Figure 29B:
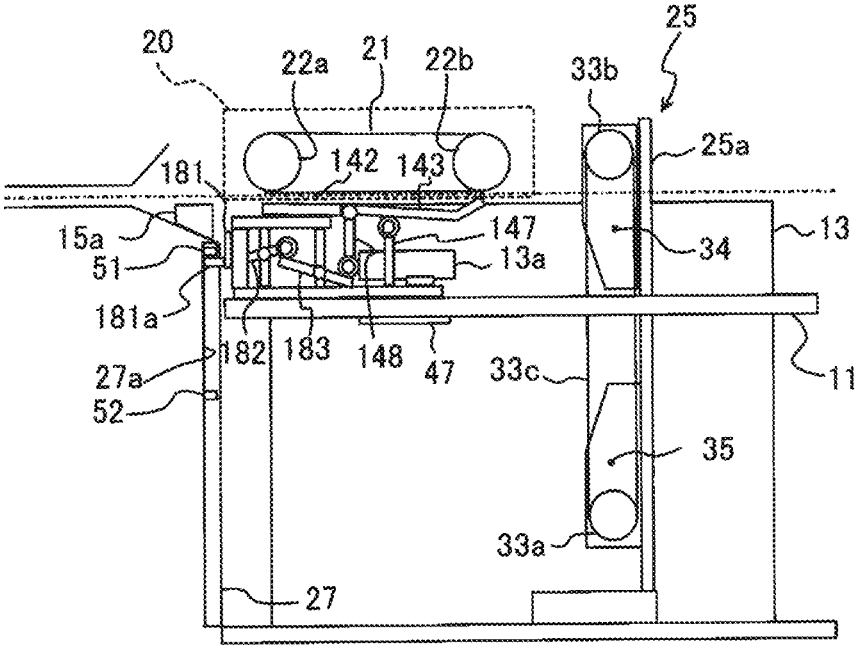
Figure 30A:
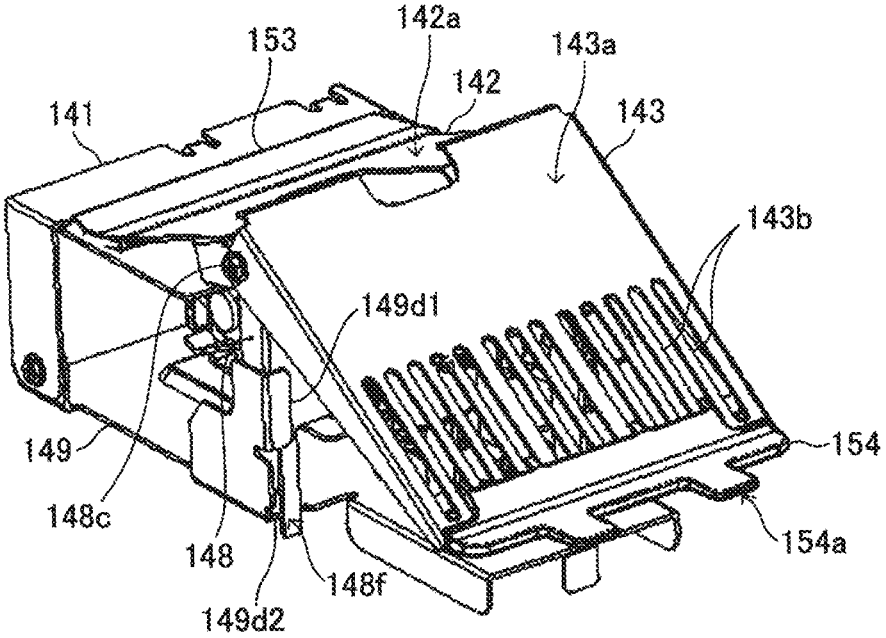
FIGS. 30A and 30B are perspective views illustrating the movable-movable loading unit when the sheet loading base is at a lowered position.
Figure 30B:
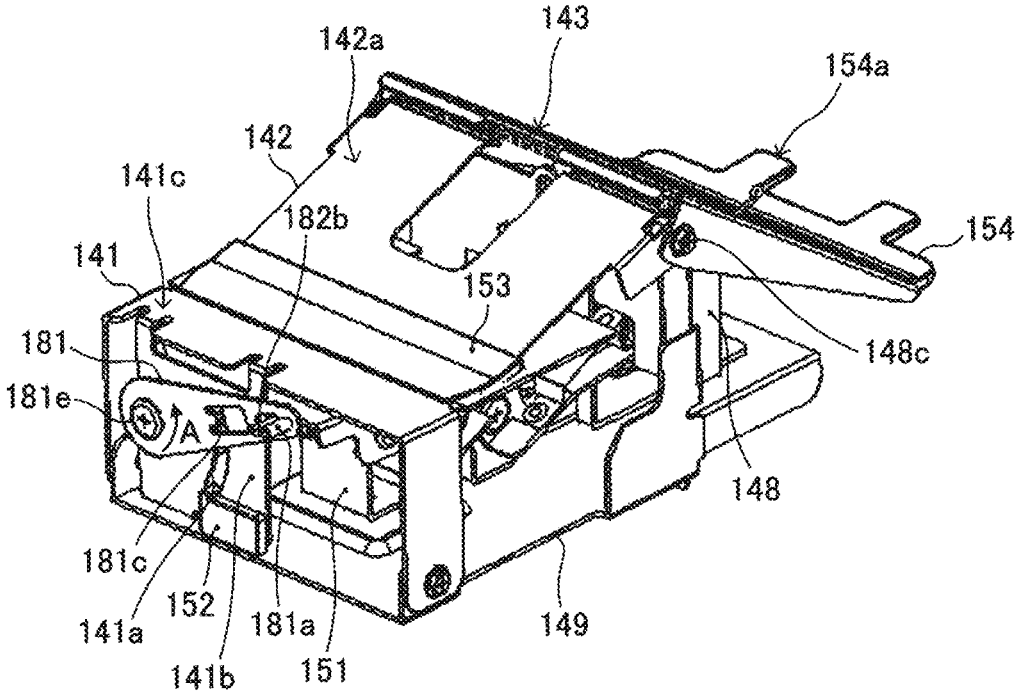
Figure 31:
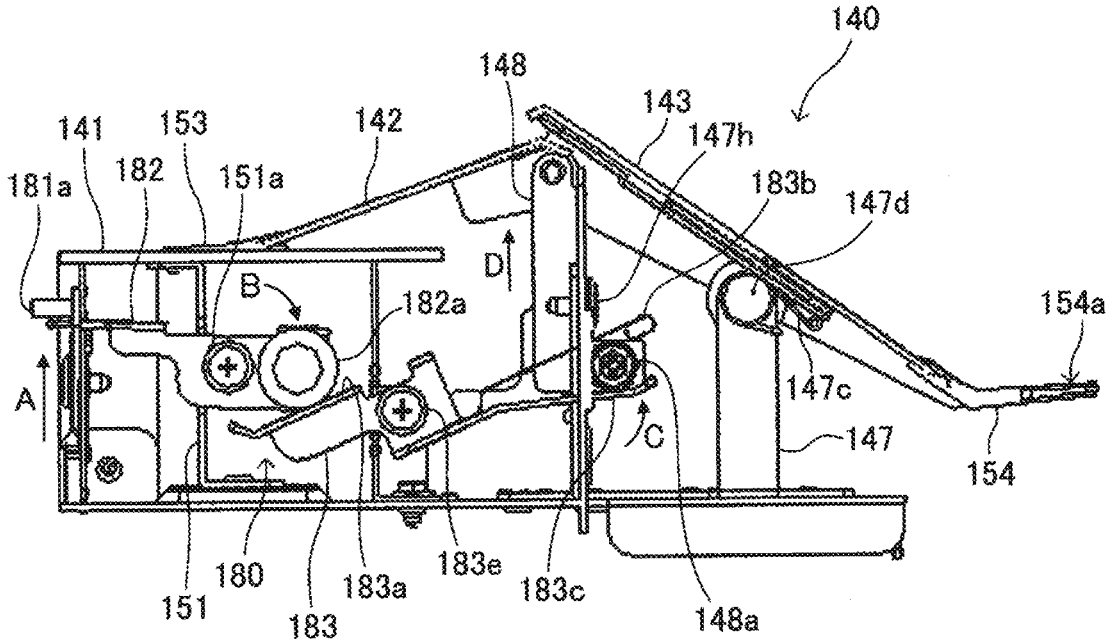
FIG. 31 is a schematic view illustrating the movable-movable loading unit when the sheet loading base is at the lowered position.

FIGS. 29A and 29B are schematic views illustrating a feeding device in which the movable-movable loading unit 140 is installed. FIG. 29A illustrates a case when the sheet loading base 11 is at a lowered position, and FIG. 29B illustrates a case when the first and second movable bases 142 and 143 reach a feeding position. FIGS. 30A and 30B are perspective views illustrating a movable-movable loading unit 140 when the sheet loading base 11 is located at a lowered position, and FIG. 31 is a schematic view illustrating the movable-movable loading unit 140 when the sheet loading base 11 is located at the lowered position.

The movable-movable loading unit 140 is secured to the sheet loading base 11 by a unit fixing plate 47, as in the fixed-movable loading unit 40.

When the sheet loading base 11 on which the movable-movable loading unit 140 is installed is lowered to a lowered position, the movable protrusion 181*a* comes in contact with the second protrusion 52. When the sheet loading base 11 is further lowered from that lowered position, the movable protrusion 181*a* is lifted by the second protrusion 52. As a result, the first rotating member 181 rotates in an arrow A direction as illustrated in FIG. 30B, so that the movable protrusion 181*a* relatively moves upward with respect to the movable-movable loading unit 140. The first rotating member 181 rotates in the arrow A direction in FIG. 30B to push up the coupling portion 182*b* of the second rotating member 182. As a result, the second rotating member 182 rotates in an arrow B direction as illustrated in FIG. 31 to push down the first roller contact portions 183*a* of the third rotating member 183.

During the rotation of the second rotating member 182, the link rollers 182*a* move on surfaces of the first roller contact portions 183*a* of the third rotating member 183. According to the present embodiment, since the link rollers 182*a* are rotatably attached to the second rotating member 182, the link rollers 182*a* move on the surfaces of the first roller contact portions 183*a* while rotating. Accordingly, the resistance against moving is reduced, the second rotating member 182 rotates smoothly, and the second rotating member 182 can push down the first roller contact portions 183*a* of the third rotating member 183.

When the first roller contact portions 183*a* of the third rotating member 183 are pushed down by the second rotating member 182, the third rotating member 183 rotates in an arrow C direction to lift the connecting rollers 148*a*, as illustrated in FIG. 31. When the connecting rollers 148*a* are lifted, the base lifting member 148 is raised, and the upstream end in the conveying direction of the first movable base 142 and the downstream end in the conveying direction of the second movable base 143 are lifted.

When the third rotating member 183 rotates, the connecting rollers 148*a* relatively move on the surfaces of the second roller contact portions 183*c* of the third rotating member 183. Since the connecting rollers 148*a* are also rotatably attached to the base lifting member 148, the connecting rollers 148*a* relatively move on the surfaces of the second roller contact portions 183*c* while rotating. Accordingly, the resistance while moving is reduced, and the third rotating member 183 rotates smoothly to lift the connecting rollers 148*a* smoothly.

As the base lifting member 148 is raised by the third moveable member 183, the first movable base 142 rotates with the upstream end in the conveying direction of the first movable base 142 as the fulcrum, and the second movable base 143 rotates with the upstream end in the conveying direction of the first movable base 142 as the fulcrum. As a result, the first movable base 142 and the second movable base 143 are tilted gradually. As illustrated in FIG. 29A, when the sheet loading base 11 lowers to a lowered position, a sheet loading surface of the movable-movable loading unit 140 forms an inverted V-shape with the center of the sheet loading unit 140 protruding upward. Note that the movable-movable loading unit 140 is composed of a first sheet loading surface 142*a* of the first movable base 142 and a second sheet loading surface 143*a* of the second movable base 143.

When the first movable base 142 is tilted as the upstream end in the conveying direction of the first movable base 142 is raised, the front-end scooping member 153 attached to a tip end of the first movable base 142 relatively moves toward an upstream side in the conveying direction with respect to the supporting surface 141*c* of the fixing base 141. According to the present embodiment, the front-end scooping member 153 is made of a material that is more slidable than the first movable base 142. Thus, the front-end scooping member 153 slides smoothly on the supporting surface 141*c* of the fixing base 141. Thus, the first movable base 142 can be tilted smoothly.

When the downstream end in the conveying direction of the second movable base 143 is lifted and the second movable base 143 is tilted, the supporting rollers 147*a* relatively move on the rear surface of the second movable base 143. Since the supporting rollers 147*a* are rotatably attached to the base supporting member 147, the supporting rollers 147*a* relatively move on a rear surface of the second movable base 143 while rotating. Thus, the second movable base 143 can be tilted smoothly.

The torsion spring 147*c* is configured to preload the second movable base 143 from the rear surface of the second movable base 143. Since a sliding sheet is attached to a contact portion of the second movable base 143 in contact with the torsion spring 147*c*, the torsion spring 147*c* slides smoothly on the surface of the sliding sheet as the second movable base 143 tilts. This configuration allows the second movable base 143 to tilt smoothly.

As the sheet loading base 11 moves up from the lowered position, the movable protrusion 181*a* does not receive a force to be pushed up from the second protrusion 52. When the first movable base 142 is tilted, the self-weight of the first movable base 142 in the lowering direction is imposed on the upstream end of the first movable table 142. As a result, the base lifting member 148 receives a depressing force from the first movable base 142. In addition, as described above, since slots 143*b* are formed on the upstream side in the conveying direction of the second movable base 143, and a spacer member 155 is disposed on the downstream side in the conveying direction of the second movable base 143, the center of gravity of the second movable base 143 is set at a more downstream side in the conveying direction of the second movable base 143 than a second movable base supporting position at which the second movable base 143 is supported by the supporting member 147. Accordingly, when the second movable base 143 is tilted, a downstream end of the second movable base 143 rotatably lowers by its self-weight with the second movable base supporting position as the fulcrum. In addition, the more upstream side in the conveying direction of the second movable base 143 than the second movable base supporting position at which the second movable base 143 is supported by the supporting member 147 is preloaded by a torsion spring 147*c*, and the torsion spring 147*c* assists in rotatably lowering the downstream end of the second movable base 143 with the second movable base supporting position as the fulcrum. As a result, the base lifting member 148 also receives a depressing force from the second movable base 143.

Thus, the self-weight of the base lifting member 148, the depressing force from the first movable base 142 to depress the base lifting member 148, and the depressing force from the second movable base to depress the base lifting member 148 are applied to the second roller contact portions 183*c* of the third movable member 183 via the connecting rollers 148*a*. The force applied to the second roller contact portions 183*c* of the third rotating member 183 through the connecting rollers 148*a* acts as a force to lift the link rollers 182*a* at contact portions between the link rollers 182*a* and the first roller contact portions 183*a*.

Further, the distance from the fulcrum of the rotation of the third rotating member 183 to the contact portion (point of effort) between the connecting rollers 148*a* and the second roller contact portions 183*c* is longer than the distance from the fulcrum of the rotation of the third rotating member 183 to the contact portion (point of load) between the link rollers 182*a* and the first roller contact portions 183*a*. Accordingly, the force applied to the second roller contact portions 183*c* of the third rotating member 183 through the connecting rollers 148*a* is amplified so as to act on the contact portions between the link rollers 182*a* and the first roller contact portions 183*a*.

Further, a force to lift the link roller 182*a* by rotation of the third rotation member 183 also acts on the contact portions between the link rollers 182*a* and the first roller contact portions 183*a*. As a result, the force to lift the link rollers 182*a* at the contact portions exceeds the force to depress the first roller contact portions 183*a* of the link roller 182*a*, and the third rotating member 183 rotates in a direction opposite to an arrow C direction in FIG. 31.

This causes the base lifting member 148 to lower, and also causes the tilting of the first movable base 142 and the tilting of the second movable base 143 to be gradual. In this case, as in the case where the base lifting member 148 is raised, moving portions of respective members relatively move smoothly so that the base lifting member 148 can be lowered smoothly. As described above, since the connecting rollers 148*a* are preloaded by the leaf spring members 183*b* to the second roller contact portions 183*c*, the base lifting member 148 can be lowered without being stopped even if the resistance against the lowering of the base lifting member 148 is slightly increased.

When the first and second movable bases 142 and 143 approach a feeding position, the first rotating member 181 comes in contact with the link stopper 152 so that the rotation of the first rotating member 181 in the opposite direction of the arrow A in FIG. 30B is restricted, and the second protrusion 52 is separated from the movable protrusion 181*a*. As a result, the movable-movable loading unit 140 becomes in an initial state. As illustrated in FIG. 29B, when the first and second movable bases 142 and 143 reach the feeding position, the first sheet loading surface 142*a* of the first movable base 142 and the second sheet loading surface 143*a* of the second movable base 143 are substantially in a horizontal orientation.

The tilting angle of each movable base and the timing of the second protrusion 52 to be separated from the movable protrusion 181*a* can be adjusted by changing the link stopper 152. For example, the tilting angles of the sheet loading surfaces 142*a* and 143*a* at the lowered position of the sheet loading base 11 can be increased by attaching a link stopper 152 having a height lower than that of the link stopper 152 illustrated in FIGS. 23A and 23B, and the timing of the second protrusion 52 to be separated from the movable protrusion 181*a* when the sheet loading base 11 is raised can be delayed.

Figure 32:
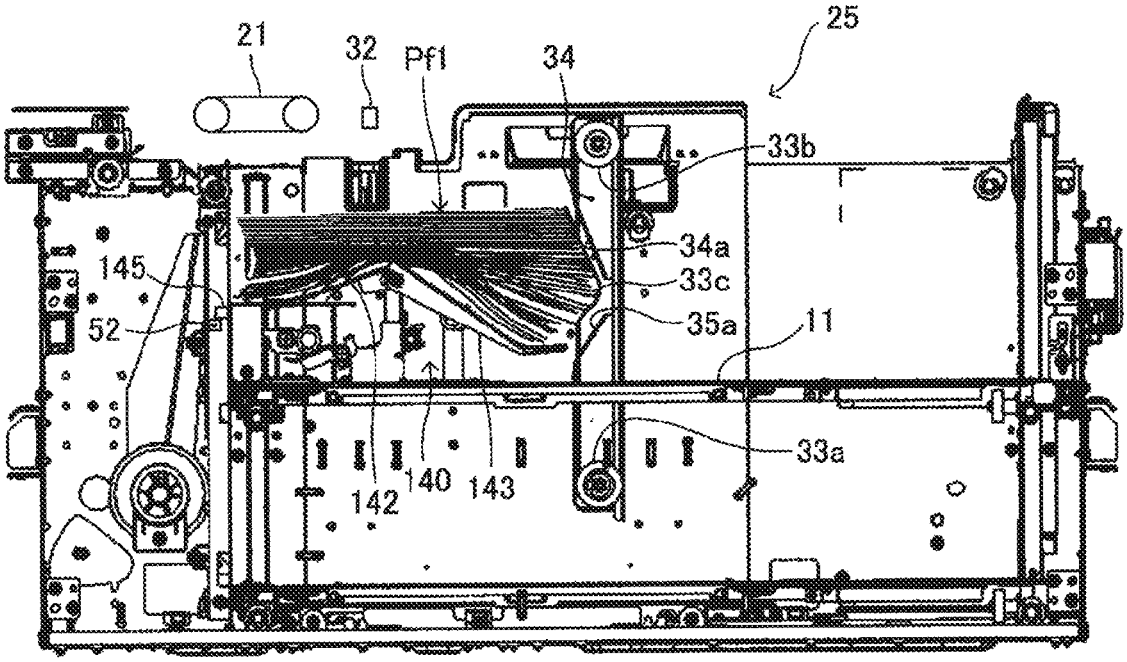
FIG. 32 is a view illustrating the feeding device having the movable-movable loading unit on which a sheet bundle with two ends spreading in a fan-shape is set.

FIG. 32 is a view illustrating a state in which a sheet bundle Pf1 with two ends spreading in a fan-shape is set in a feeding device to which a movable-movable loading unit 140 is attached. To set a sheet bundle, the sheet loading base 11 is at a lowered position. In this case, the movable protrusion 181*a* is raised by the second protrusion 52, and the first movable base 142 and the second movable base 143 are tilted such that the sheet loading surface (composed of the first movable base 142 and the second movable base 143) forms an inverted V-shape. Accordingly, when the sheet bundle Pf1 with two ends spreading in a fan-shape in the conveying direction is set to the movable-movable loading unit 140, the two ends spreading in a fan-shape in the conveying direction of a lower part of the sheet bundle Pf1 are tilted along the tilting of the first movable base 142 and the tilting of the second movable bases 143, respectively. As a result, the fan-shaped spread of two ends of an upper part of the sheet bundle Pf1 is reduced. This makes the top surface of the sheet bundle Pf1 substantially flat. Accordingly, it is possible to efficiently perform lifting control on the basis of detection results of the sheet detecting sensor 31 and the end sensor 32 as in the case where the sheet bundle composed of the sheets without the thickness deviation is set. Further, since the top surface of the sheet bundle Pf1 can be substantially flat, the top sheet can float efficiently and be suctioned onto the suction belt 21.

In addition, the first sheet loading surface 142*a* of the first movable base 142 and the second sheet loading surface 143*a* of the second movable base 143 may form an inverted V-shaped portion of a sheet loading surface of the movable-movable base 140 (a position raised and lowered by the base lifting member 148). Such an inverted V-shaped portion of the sheet loading surface of the movable-movable base 140 may not be necessarily located at the center in the conveying direction of the sheet bundle, but may be located at the downstream side in the conveying direction of the sheet bundle. As can be seen from FIG. 32, the suction belt 21 for feeding a sheet, and the end sensor 32 and the sheet detecting sensor 31 for performing lifting control of the sheet loading base 11 are positioned at the downstream side in the conveying direction of the sheet bundle. Thus, if at least the downstream side in the conveying direction of the top surface of the sheet bundle is horizontal, the feeding can be performed efficiently despite there being a slight difference in height between the upstream side and the downstream side in the conveying direction of the sheet bundle.

According to the present embodiment, the front-end scooping member 153 having a slope inclined with respect to the first sheet loading surface 142*a* is attached to the downstream end in the conveying direction of the first movable base 142. Thus, as illustrated in FIG. 30B and FIG. 31, the tilting angle of the first movable base 142 with respect to the supporting surface 141*c* of the fixing base 141 when the first movable base 142 is tilted is reduced, where the front end of the sheet bundle is loaded on the supporting surface 141*c* of the fixing base 141. When the sheet bundle Pf1 is moved to the downstream side in the conveying direction during setting of the sheet bundle Pf1, it is possible to prevent the bottom sheet of the sheet bundle from being caught. In addition, since the front-end scooping member 153 is made of a material that is more slidable than the first movable base 142, the sheet bundle can be moved smoothly toward the downstream side in the conveying direction when the sheet bundle is set, thereby further preventing the bottom sheet of the sheet bundle from being caught.

Figure 33:
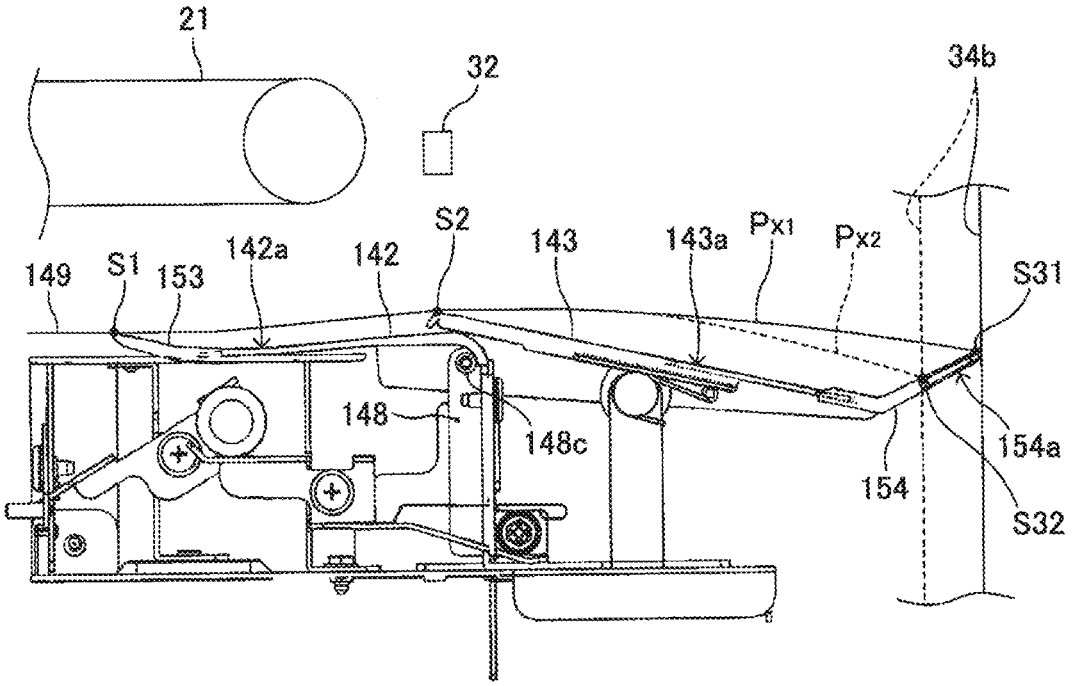
FIG. 33 is a view illustrating the movable-movable loading unit on which a last one of sheets of the sheet bundle is loaded.

FIG. 33 is a view illustrating a state in which the last sheet of the sheet bundle is loaded on the movable-movable loading unit 140. A solid line Px1 in FIG. 33 indicates a sheet having a maximum length that can be loaded on the movable-movable loading unit 140, and a dashed line Px2 in FIG. 33 indicates a sheet having a minimum length that can be loaded on the movable-movable loading unit 140. In a case of the sheet having the maximum length Px1, the contact surface 34*b* of the end fence 25 is located at a position indicated by the solid line in FIG. 33. In a case of the sheet having the minimum length Px2, the end fence 25 is interposed between the protruding portions 154*a* of the rear-end supporting member 154, so that the contact surface 34*b* of the end fence 25 is located at a position indicated by the dashed line in FIG. 33.

When the last sheet is loaded on the movable-movable loading unit 140, the movable protrusion 181*a* is separated from the second projection 52, and the first movable base 142 and the second movable base 143 are in initial orientations. In this case, the front-end scooping member 153 is floated from the supporting surface 141*c* of the fixing base 141. Further, a second movable base supported position of the supporting rollers 147*a* is positioned lower than a second movable base supported position (position of the stepped screws 148*c*) of the base lifting member 148. Hence, the second movable base 143 is gently tilted so that the upstream side in the conveying direction of the second movable base 143 is positioned lower than the downstream side in the conveying direction of the second movable base 143. The downstream end in the conveying direction of the second movable base 143 overlaps the upstream end in the conveying direction of the first movable base 142. Further, tip ends of a pair of protruding portions 154*a* of the rear-end supporting member 154 attached to the upstream end in the conveying direction of the second movable base 143 are positioned higher than the upstream side of the second sheet loading surface 143*a* of the second movable base 143.

Thus, the final sheet of the sheet bundle is supported at three points, which are a tip end S1 of the front-end scooping member 153, the downstream end S2 of the second movable base 143 in the conveying direction, and an interval between a tip end S31 and a root end S32 of the protruding portion 154*a* of the rear-end supporting member 154, as illustrated in FIG. 33.

Since the tip end S1 of the front-end scooping member 153 and the downstream end S2 of the second movable base 143 are substantially at the same position (level) in the vertical direction, a portion of a sheet facing the suction belt 21 and a portion of the sheet facing the end sensor 32 are in a substantially horizontal state on the movable-movable loading unit 140. Accordingly, sheet adsorption onto the suction belt 21 and the sheet detection by the end sensor 32 can be performed efficiently.

The movable-movable loading unit 140 also has a rotation range of less than 90 degrees for each rotating member of the link mechanism 180. This allows the movable-movable loading unit 140 to be downsized.

The above-described embodiment illustrates an example in which the base lifting member 148 acting as a supporting member configured to rotatably support an upstream end in the conveying direction of the first movable base 142 and a downstream end in the conveying direction of the second movable base 143 is raised and lowered such that the first movable base 142 and the second movable base 143 illustrated in FIG. 29A are in a tilted orientation, and the first movable base 142 and the second movable base 143 illustrated in FIG. 29B are in a substantially horizontal orientation. However, the present embodiment is not limited thereto. For example, when the downstream end in the conveying direction of the first movable base 142 is raised and lowered by a solenoid or the like as the sheet loading base 11 moves up and down, the first movable base 142 is rotated with the upstream end in the conveying direction of the first movable base 142 as the fulcrum to be in a tilted orientation and in a substantially horizontal orientation. When the upstream end in the conveying direction of the second movable base 143 may be raised or lowered by a solenoid or the like, the second movable base 143 is rotated with the downstream end in the conveying direction of the second movable base 143 as the fulcrum to be in a tilting orientation and in a substantially horizontal orientation.

In the feeding device according to the present embodiment, to feed a sheet bundle with two ends spreading in a fan-shape, the movable-movable loading unit 140 can be attached to the sheet loading base 11 so as to perform the feeding efficiently. To feed a sheet bundle with one end spreading in a fan-shape, a fixed-movable loading unit 40 can be attached to the sheet loading base 11 so as to perform feeding efficiently. When a sheet bundle is uniformly thick and does not spread in a fan-shape, the sheet bundle can be directly loaded onto the sheet loading base 11 without attaching a loading unit to the sheet loading base 11 so as to perform feeding efficiently. As described above, according to the present embodiment, feeding of various types of sheet bundles can be performed efficiently, versatility of a feeding device can be improved, and a user-friendly feeding device can be provided.

The above-described embodiments are examples and have specific effects for each of the following modes.

(Mode 1)

According to Mode 1, a loading unit (such as a movable-movable loading unit 140) for use in loading a bundle of objects to be conveyed (such as a bundle of sheets) is provided, wherein the loading unit is installed on a lifting member (such as a sheet lifting base 11 of a feeding device 200). The loading unit 140 includes a first movable base 142 on which a downstream side in a conveying direction of the bundle of objects is loaded, the first movable base 142 being rotatable; and a second movable base 143 on which an upstream side in the conveying direction of the bundle of objects is loaded, the second movable base 143 being rotatable and disposed at a more upstream side than the first movable base 142 in a conveying direction of an object (such as a sheet) to be conveyed. According to this configuration, since the first movable base 142 and the second movable base 143 are configured to be rotatable, both the first movable base 142 and the second movable base 143 can be tilted. Thus, the first movable base 142 can be tilted so that the downstream side in the conveying direction of the first movable base 142 is lower than the upstream side in the conveying direction of the first movable base 142, and the second movable base 143 can be tilted so that the upstream side in the conveying direction of the second movable base 143 is lower than the downstream side in the conveying direction of the second movable base 143. As a result, a loading part composed of the first movable base 142 and the second movable base 143 forms an inverted V-shape wherein an approximate center in the conveying direction of the loading part is higher than the two ends in the conveying direction of the loading part. Accordingly, when the bundle of objects having two ends in the conveying direction thicker than the center thereof in the conveying direction is loaded on the loading part, the difference in height between the center and the two ends in the conveying direction of the top surface of the bundle of objects can be reduced. As a result, the objects having two ends in the conveying direction thicker than the center thereof in the conveying direction can be efficiently fed. As the height deviation between the center and the two ends in the conveying direction of the bundle of the objects decreases with a decrease in the number of objects in the bundle, the first movable base 142 and the second movable base 143 are rotated such that the tilting of the first movable base 142 and the tilting of the second movable base 143 decrease. Accordingly, even when the number of objects in the bundle is decreased, the difference in height between the center and two ends in the conveying direction of the top surface of the bundle of objects can be reduced. Thus, it is possible to efficiently feed an object having two ends in the conveying direction thicker than the center thereof in the conveying direction. In addition, when only the downstream side in the conveying direction of the bundle of objects is thick, and the length in the conveying direction of the bundle of objects is greater than the length in the conveying direction of the loading part, the upstream side in the conveying direction of the bundle of objects may also spread in a fan-shape manner. Thus, the two ends in the conveying direction of the bundle of objects spread in a fan-shape manner. In the loading unit according to Mode 1, a bundle of objects (such as sheets) can still be fed efficiently even in such a case.

(Mode 2)

In the loading unit according to Mode 1, the first movable base 142 and the second movable base 143 rotate in accordance with an elevation of a lifting member (such as a sheet loading base 11). According to this configuration, as described in the above embodiment, the first movable base 142 and the second movable base 143 can be rotated so that the tilting of the first movable base 142 and the tilting of the second movable base 143 decrease as the number of objects in the bundle of objects decreases. Accordingly, even when the number of objects in the bundle of objects is small, the difference in height between the center in the conveying direction of a top surface of the bundle of objects and two ends in the conveying direction of the top surface of the bundle of objects can be reduced, and it is possible to feed an object having two ends in the conveying direction thicker than the center thereof in the conveying direction.

(Mode 3)

The loading unit according to Mode 1 or 2, further includes a supporting member configured to rotatably support an upstream end in the conveying direction of the first movable base 142 and rotatably support a downstream end in the conveying direction of the second movable base 143. According to this configuration, the first movable base 142 can be rotated with the supporting member as the fulcrum. Accordingly, the first movable base 142 is tilted so that a downstream side in the conveying direction of the first movable base 142 is lower than an upstream side in the conveying direction of the first movable base 142, or the first movable base 142 is rotated so that the downstream side in the conveying direction of the first movable base 142 and the upstream side in the conveying direction of the first movable base 142 are in a horizontal orientation. The second movable base 143 can be rotated with the supporting member as the fulcrum. Accordingly, the second movable base 143 is tilted so that an upstream side in the conveying direction of the second movable base 143 is lower than a downstream side in the conveying direction of the second movable base 143, or the second movable base 143 is rotated so that the downstream side in the conveying direction of the second movable base 143 and the upstream side in the conveying direction of the second movable base 143 are in a horizontal orientation.

(Mode 4)

In the loading unit according to Mode 3, the supporting member is a base lifting member 148 configured to raise and lower an upstream end in the conveying direction of the first movable base 142, and a downstream end in the conveying direction of the second movable base 143, wherein the first movable base 142 and the second movable base 143 rotate as the base lifting member 148 moves up and down. According to this configuration, as described in the above embodiment, the upstream end in the conveying direction of the first movable base 142 and the downstream end in the conveying direction of the second movable base 143 are raised by the base lifting member 148. As a result, the first movable base 142 is tilted so that the downstream side in the conveying direction of the first movable base 142 is lower than the upstream side in the conveying direction of the first movable base 142, and the second movable base 143 is tilted so that the upstream side in the conveying direction of the second movable base 143 is lower than the downstream side in the conveying direction of the second movable base 143. Accordingly, a loading part (such as a sheet loading surface) composed of the first movable base 142 and the second movable base 143 forms an inverted V-shape with the center being higher than two ends thereof in the conveying direction. The tilting of the first movable base 142 and the tilting of the second movable base 143 can be reduced by lowering the base lifting member 148 from a raised position of the base lifting member 148 in accordance with a decrease in the number of objects in the bundle of objects to be conveyed. Accordingly, even when the number of objects in the bundle of objects is small, the difference in height between the upstream side and the downstream side in the conveying direction of the top surface of the bundle of objects can be reduced. Thus, it is possible to feed an object having two ends in the conveying direction thicker than the center thereof in the conveying direction.

(Mode 5)

In the loading unit according to Mode 4, when the lifting member (such as the sheet loading base 11) is at a lowered position, the base lifting member 148 is at a raised position, and the base lifting member 148 is lowered as the lifting member rises. According to this configuration, as described in the above embodiment, as the number of the objects in the bundle of objects decreases, the base lifting member 148 moves downward from the raised position. Further, even when the number of the objects in the bundle of objects decreases, the difference in height between the upstream side and the downstream side in the conveying direction of a top surface of the bundle of objects can be reduced. Thus, the objects having the upstream side and the downstream side in the conveying direction thicker than the center thereof in the conveying direction can be efficiently fed.

(Mode 6)

The loading unit according to Modes 4 or 5, further includes a link mechanism 180 configured to raise and lower the base lifting member 148. According to this configuration, the base lifting member 148 can be raised and lowered by the link mechanism 180.

(Mode 7)

In the loading unit according to Mode 6, the link mechanism 180 includes a plurality of link members (according to the present embodiment, the first rotating member 181, the second rotating member 182, and the third rotating member 183), and at least one of the plurality of link members (according to the present embodiment, the second rotating member 182) has rotating members (such as link rollers 182*a*) configured to be in contact with another link member (the third rotating member 183 according to the present embodiment). According to this configuration, as described in the above embodiment, when a link member (such as the second rotating member 182), or another link member (such as the third rotating member 183) is rotated, the rotating members (such as link rollers 182*a*) move relatively on the surface of the other link member while rotating. This configuration allows the link member to be rotated smoothly, and allows the base lifting member 148 to be raised and lowered smoothly.

(Mode 8)

In the loading unit according to Modes 6 or 7, the base lifting member 148 is connected to a link mechanism 180 via rotating members (such as connecting rollers 148*a*). According to this configuration, as described in the above embodiment, when a link member (such as the third rotating member 183 of the link mechanism 180) is rotated, the rotating members (such as the connecting rollers 148*a*) move relatively on the surface of the link member while rotating. This allows the link member to be rotated smoothly, and allows the base lifting member 148 to be raised and lowered smoothly.

(Mode 9)

The loading unit according to any one of Modes 6 to 8, further includes pressing members (such as leaf spring members 183*b*) configured to press connecting portions (such as connecting rollers 148*a* of the base lifting member 148) against connected portions (such as second roller contact portions 183*c*) of the link mechanism 180. According to this configuration, as described in the above embodiment, when the connected portions (such as the second roller contact portions 183*c*) rotate in a direction away from the connecting portions (such as the connecting rollers 148*a*), the link member (such as the third rotating member) of the link mechanism 180 can make the connecting portions (such as the connecting rollers 148*a*) to efficiently follow the connected portions (such as the second roller contact portions 183*c*). This allows the base lifting member 148 to be efficiently raised and lowered by the link mechanism 180.

(Mode 10)

In the loading unit according to any one of Modes 4 to 9, the base lifting member 148 is lowered from a raised position to a lowered position with self-weight of at least one of the base lifting member 148, the first movable base 142, or the second movable base 143. According to this configuration, the base lifting member 148 can be lowered without using a driving source such as a motor.

(Mode 11)

The loading unit according to Mode 10, further includes a base supporting member 147 configured to support the second movable base 143 at a second movable base supporting position at which the second movable base 143 is supported by the base supporting member 147 in the conveying direction, wherein the center of gravity of the second movable base 143 is at a more downstream side in the conveying direction than the second movable base supporting position. According to this configuration, the second movable base 143 can be rotated by the self-weight of the second movable base 143 to lower a downstream side in the conveying direction of the second movable base 143 with the second movable base supporting position as the fulcrum, as described in the above embodiments. Thus, the base lifting member 148 receives a force pushed down by the self-weight from the second movable base 143 so that the base lifting member 148 can be lowered by the self-weight of the second movable base 143.

(Mode 12)

In the loading unit according to Mode 11, the second movable base 143 has a plurality of slots 143*b* disposed at a more upstream side in the conveying direction than the second movable base supporting position at which the second movable base 143 is supported by the base supporting member 147. According to this configuration, the more upstream side in the conveying direction of the second movable base 143 than the second movable base supporting position at which the second movable base 143 is supported by the base supporting member 14 can be lightened, and the center of gravity of the second movable base 143 can be set at a more downstream side in the conveying direction of the second movable base 143 than the second movable base supporting position at which the second movable base 143 is supported by the base supporting member 147, as described in the above embodiment.

(Mode 13)

The loading unit according to Modes 11 or 12 further includes a weight member (such as a spacer member 155) disposed at a more downstream side in the conveying direction than the second movable base supporting position at which the second movable base 143 is supported by the base supporting member 147. According to this configuration, as described in the above embodiment, the more downstream side in the conveying direction than the second movable base supporting position at which the second movable base 143 is supported by the base supporting member 147 can be made heavier, and the center of gravity of the second movable base 143 can be located at a more downstream side in the conveying direction than the second movable base supporting position at which the second movable base 143 is supported by the base supporting member 147.

(Mode 14)

The loading unit according to any one of Modes 11 to 13 further includes a preloading member (such as a torsion spring 147*c*) configured to preload a more upstream side in the conveying direction of the second movable base 143 in an upward direction than the second movable base supporting position at which the second movable base 143 is supported by the base supporting member 147. According to this configuration, the preloading by the preloading member (such as a torsion spring 147*c*) can assist the rotation of the second movable base 143 such that the downstream side in the conveying direction of the second movable base 143 is lowered by the self-weight of the second movable base 143 with the second movable base supporting position as the fulcrum.

(Mode 15)

The loading unit according to any one of Modes 11 to 14, contact portions of the base supporting member 147 that come in contact with the second movable base 143 are rotating members (such as supporting rollers 147*a*). According to this configuration, as described in the above embodiment, during the rotation of the second movable base 143, the rotating members, such as the supporting rollers 147*a*, rotate while relatively moving on the surface of the second movable base 143. This configuration can reduce the sliding resistance of the second movable base 143 against the base supporting member 147 during rotation, thereby rotating the second movable base 143 smoothly.

(Mode 16)

In the loading unit according to any one of Modes 4 to 15, the base lifting member 148 is positioned at the center in the conveying direction of the loaded bundle of objects or at the downstream side in the conveying direction of the bundle of objects. According to this configuration, as described in the above embodiment, a more upstream side of the top surface of the bundle of objects, at which the suction belt 21, the sheet detecting sensor 31, and the end sensor 32 are disposed, than at least the center of the top surface of the bundle of objects may be made substantially horizontal. Thus, it is possible to perform efficient lifting control of the lifting member (such as the sheet loading base 11) and feeding of the bundle of objects.

(Mode 17)

The loading unit according to any one of Modes 1 to 16, includes a slope member (such as a front-end scooping member 153) inclined with respect to an object bundle loading surface (such as a first sheet loading surface 142*a* of a first movable base 142), on which the bundle of objects is loaded, wherein the slope member is disposed at a downstream end in the conveying direction of the first movable base 142. According to this configuration, as described in the above embodiment, when the first movable base 142 is tilted, an angle between the first movable base 142 and the supporting surface of the fixing base 141 that supports the downstream side in the conveying direction of the first movable base 142 can be made gentle. According to this configuration, when setting a bundle of objects (such as a sheet bundle), it is possible to prevent a front end of a bottom object of the bundle of objects from being turned upward.

(Mode 18)

In the loading unit according to Mode 17, a slope member (such as the front-end scooping member 153) is made of a material (resin in the present embodiment) that is more slidable than the first movable base 142. According to this configuration, as described in the above embodiment, when the bundle of objects (such as a sheet bundle) is set, a front end of a bottom object of the bundle of objects slides smoothly on the slope member, thereby further preventing the front end of the bottom object of the bundle of objects from being caught. Accordingly, it is possible to further prevent the front end of the bottom object to be conveyed from being turned upward.

(Mode 19)

In the loading unit according to any one of Modes 1 to 18, a rear-end supporting member 154 having a pair of protruding portions 154*a* is disposed on an upstream end in the conveying direction of the second movable base 143, where the pair of protruding portions 154*a* protrude toward an upstream side in the conveying direction from a position at which the protruding portions 154*a* do not face the end fence 25 of the feeding device in a width direction of the object to be conveyed. According to this configuration, as described in the above embodiment, the rear end of the bundle of objects can be prevented from being deflected downward, and the end fence 25 can be brought into contact with the rear end of the bundle of objects having different lengths in the conveying direction. This configuration reduces the costs compared to a case where a plurality of movable-movable loading units is disposed according to the lengths of the bundle of objects. Also, there is no need to replace the loading unit every time a bundle of objects has a different length, and convenience can be improved compared to a case where a plurality of movable-movable loading units is disposed according to the different lengths of sheets.

(Mode 20)

In the loading unit according to Mode 19, a plurality of rear-end supporting members 154 having protruding portions 154*a* with different lengths is selectively attached to the upstream end in the conveying direction of the second movable base 143. According to this configuration, as described in the above embodiment, the rear-end supporting member 154 can be replaced with another rear-end supporting member 154' so as to handle various lengths of bundles of objects.

(Mode 21)

A feeding device 200 includes the loading unit according to any one of Modes 1 to 20 for use in loading a bundle of objects (such as a bundle of sheets), the loading unit being installed on a lifting member (such as a sheet loading base 11);

a conveying unit (such as a feeding unit 20) configured to convey a top object of the bundle of objects to be conveyed loaded on the loading unit; and an end fence 25 configured to be movable in a conveying direction of an object to be conveyed, and come in contact with a rear end of the bundle of objects to restrict a position of the rear end of the bundle of objects. According to this configuration, as described in the above embodiment, objects having the two ends thicker than the center thereof in the conveying direction can be efficiently fed.

(Mode 22)

The feeding device 200 according to Mode 21, further includes elastic deforming members (such as belt members 33*c*) disposed at a predetermined portion of the end fence 25 excluding at least an upper portion of the end fence 25. When objects to be conveyed have a large thickness deviation in the conveying direction and such objects are bundled, the thicker end of the bundle of objects spreads in a fan-shape. When the fan-shape spreading end of the bundle of objects that is set as the rear end side in the conveying direction is loaded on the loading part, a rear end of an upper part of the bundle of objects is positioned at a more downstream side in the conveying direction than a rear end of the other part of the bundle of objects. Thus, even if a user moves the end fence 25 so that the end fence 25 abuts against the rear end of the bundle of the objects in the conveying direction, a gap is generated between the upper part of the bundle of objects and the end fence 25. As a result, the upper part of the bundle of objects may be retracted in a direction separating from the end fence 25, which causes poor feeding or delay in feeding. As a result, the bundle of objects may not be fed efficiently. Thus, in this Mode 22, the elastic deforming members are disposed at a predetermined portion of the end fence 25 excluding at least the upper portion of the end fence 25. According to this configuration, when the end fence 25 is moved so that the elastic deforming members are in contact with the rear end of the bundle of the objects spreading in a fan-shape set on the loading unit, the elastic deforming members elastically deform along the fan-shape spreading end of the bundle of objects, allowing the end fence 25 to further move toward the bundle of objects. As a result, the upper portion of the end fence 25 can be in contact with the rear end of the upper part of the bundle of objects, particularly in contact with the rear end of the uppermost part of the objects to be conveyed. Thus, the position of the rear end of the upper part of the bundle of objects can be efficiently restricted by the end fence 25 so that the upper part of the bundle of objects is prevented from being retracted in a direction separating from the end fence 25 upon feeding. As a result, poor feeding or delay in feeding can be prevented from occurring, and efficient feeding can be performed.

(Mode 23) In the feeding device 200 according to Mode 22, the predetermined portion is a middle portion in a vertical direction of the end fence 25. According to this configuration, since the predetermined portion is the middle portion in the vertical direction of the end fence 25, the sheet bundle can be loaded more stably.

(Mode 24)

In the feeding device 200 according to Mode 23, the loading part (such as the feeding tray 10) includes a lifting member (such as a sheet loading base 11) configured to raise and lower a loaded bundle of objects to be conveyed, so that at least portions of the elastic deforming members (such as the belt members 33*c*) that face the bundle of objects to be conveyed move in a vertical direction as the bundle of objects to be conveyed is raised or lowered. According to this configuration, as described in the above embodiment, since the lifting member can raise or lower the elastic deforming members (such as the belt members 33*c*) together with the bundle of objects to be conveyed in a vertical direction, the bundle of the objects to be conveyed can be raised and lowered smoothly, compared to a related art case where the rear end in the conveying direction of the bundle of objects is raised and lowered while sliding on the elastic deforming members.

(Mode 25)

In the feeding device according to Mode 24, surfaces of the elastic deforming members (such as the belt members 33*c*) have an uneven shape (rough surfaces). According to this configuration, frictional force between the elastic deforming members (such as the belt members 33*c*) and the rear end of the bundle of objects can be increased, thereby ensuring that the elastic deforming members move up and down as an object to be conveyed moves up and down.

(Mode 26)

In the feeding device according to Modes 24 or 25, each of the elastic deforming members is a belt member 33*c* having an endlessly movable surface supported by the end fence 25. According to this configuration, the facing portion of the elastic deforming member facing at least an object to be conveyed to be moved up and down (moved in a vertical direction) in a simple configuration.

(Mode 27)

The feeding device according to Mode 26 further includes an adjusting mechanism (such as a pair of belt controllers 33) configured to adjust tension of the belt members. According to this configuration, as described in the above embodiment, optimum tension of the belt members can be adjusted with respect to resilience of an object to be conveyed (such as a sheet), and when the belt members abut against the rear end of the sheet bundle and the belt members are elastically deformed, a defect (such as the sheet being bent) due to tension can be prevented from occurring.

(Mode 28)

In the feeding device according to any of Modes 22 to 27, elastic deforming members (such as belt members 33*c*) are disposed at two respective sides of the end fence 25 in a width direction of the object to be conveyed. According to this configuration, the rear end of the sheet bundle can be restricted by a pair of elastically deforming members (such as belt members 33*c*), so that the position of the rear end of the sheet bundle can be controlled stably.

(Mode 29)

In the feeding device according to Mode 28, elastic forces of the elastic deforming members disposed at two respective sides of the end fence 25 are the same. According to this configuration, as described in the above embodiment, since the elastic force applied to one side of the bundle of the objects and the elastic force applied to the other side of the bundle of the objects can be made the same, an object to be conveyed can be prevented from being bent.

(Mode 30)

In the feeding device according to any of Modes 22 to 29, the elastic deforming members move in the conveying direction together with the end fence 25. According to this configuration, when the end fence 25 abuts against the rear end of the sheet bundle, the elastic deforming members abut against the rear end of the sheet bundle.

(Mode 31)

The feeding device according to any one of Modes 22 to 30 further includes an upper restriction member 34 disposed on an upper part of the end fence 25. The upper restriction member 34 protrudes from the elastic deforming members toward an object to be conveyed, and is configured to restrict a position of the rear end of an upper part of the bundle of objects in the conveying direction. According to this configuration, as described in the above embodiment, the rear end of the upper part of the bundle of objects (such as the sheet bundle) can be restricted more reliably compared to a case where the rear end of the upper part of the bundle of objects is restricted only by the elastic deforming members. Thus, the upper part of the sheet bundle can be reliably prevented from being retracted in a direction separating from the end fence 25.

(Mode 32)

In the feeding device according to Mode 31, the upper restriction member 34 includes a slope (such as a guiding slope 34*a*) having an inclined surface that is gradually separated from an object to be conveyed in a downward direction of the upper restriction member 34. According to this configuration, as described in the above embodiment, when the sheet bundle is raised, the rear end of the sheet bundle in contact with the elastic deforming members (such as the belt members 33*c*) can be smoothly transferred from the elastic deforming members to the upper restriction member 34.

(Mode 33)

The feeding device according to any one of Modes 22 to 32 further includes a lower restriction member 35 disposed on a lower part of the end fence 25. The lower restriction member 35 protrudes from the elastic deforming members (such as the belt members 33*c*) toward an object to be conveyed, and is configured to restrict a position of a rear end of a lower part of the bundle of objects in the conveying direction. According to this configuration, as described in the above embodiment, the rear end of the lower part of the bundle of objects (such as the sheet bundle) can be restricted more reliably compared to a case where the rear end of the lower part of the bundle of objects is restricted only by the elastic deforming members. This reliably prevents the lower part of the sheet bundle from being retracted in a direction separating from the end fence 25.

(Mode 34)

In the feeding device according to Mode 33, the lower restriction member 35 includes a slope (such as a guiding slope 35*a*) having an inclined surface that is gradually separated from an object to be conveyed in an upward direction of the lower restriction member 35. According to this configuration, as described in the above embodiment, when the sheet bundle is raised, the rear end of the sheet bundle in contact with the elastic deforming members (such as the belt members 33*c*) can be smoothly transferred to the upper restriction member 35.

(Mode 35)

In the feeding device according to any one of Modes 21 to 34, a first loading unit (such as a movable-movable loading unit 140) or a second loading unit (such as a fixed-movable loading unit 40) is optionally selectable as the loading unit installed on a lifting member (such as a sheet loading base 11) The second loading unit (such as a fixed-movable loading unit 40) includes a fixing base 41, and a movable base 42 configured to be rotatable and disposed at a more upstream side than the fixing base 41 in the conveying direction. The first loading unit 140 includes a link mechanism 180 configured to raise or lower a base lifting member 148, wherein the base lifting member 148 is configured to raise or lower an upstream end in the conveying direction of the first movable base 142 and a downstream end in the conveying direction of the second movable base 143, and wherein the upstream end in the conveying direction of the first movable base 142 and the downstream end in the conveying direction of the second movable base 143 are rotatably attached to the link mechanism 180. The second loading unit 40 includes a link mechanism 48 configured to move the movable base 42, a first drive portion (such as a second protrusion 52) configured to come in contact with the link mechanism 180 of the first loading unit 140 to drive the link mechanism 180 of the first loading unit 140 as the lifting member 11 (sheet loading base 11) lowers, and a second drive portion (such as a first protrusion 51) disposed at a position differing from the first drive portion in the width direction of the object to be conveyed and configured to come in contact with the link mechanism 48 of the second loading unit to drive the link mechanism 48 of the second loading unit as the lifting member 11 (sheet loading base 11) rises. According to this configuration, the link mechanism 180 of the first loading unit 140 and the link mechanism 48 of the second loading unit 40 can be driven as the lifting member 11 (sheet loading base 11) rises or lowers.

(Mode 36)

An image forming apparatus according to Mode 36 includes an image forming unit configured to form an image on an object to be conveyed such as a sheet, and a feeding unit configured to feed the object to the image forming unit, wherein the feeding unit is the feeding device according to any one of Modes 21 to 35. According to this configuration, even when a bundle of objects composed of the objects having the thickness deviation in the conveying direction is set on the feeding unit, the bundle of objects can be fed efficiently.

(Mode 37)

An image forming system according to Mode 37 includes at least an image forming apparatus having an image forming unit configured to form an image on an object to be conveyed, and a feeding device configured to feed the object to the image forming apparatus, wherein the feeding device is the feeding device according to any one of Modes 21 to 35. According to this configuration, even when a bundle of objects each having the thickness deviation in the conveying direction is set on the feeding device, feeding of the objects can be performed efficiently.

[Effects of the Invention]

According to the present invention, it is possible to efficiently feed a bundle of objects each having an end in a conveying direction thicker than that of the center.

What is claimed is:

1. A loading mechanism for use in loading a bundle of objects to be conveyed, the loading mechanism being installed on a lifting member of a feeding device, the loading mechanism comprising:

a first movable base on which a downstream side in a conveying direction of a bundle of objects to be conveyed is loaded, the first movable base being rotatable;

a second movable base on which an upstream side in the conveying direction of the bundle of objects is loaded, the second movable base being rotatable and on a more upstream side in the conveying direction than the first movable base; and a supporting member configured to, rotatably support an upstream end in the conveying direction of the first movable base, and rotatably support a downstream end in the conveying direction of the movable base, wherein the supporting member is a base lifting member configured to raise and lower the upstream end of the first movable base and the downstream end of the second movable base, the first movable base and the second movable base are configured to rotate in accordance with a raising and a lowering of the base lifting member, in response to the lifting member bring at a lowered position, the base lifting member is further configured to be at a raised position, and the base lifting member is further configured to be lowered as the lifting member rises.

2. The loading mechanism according to claim 1, further comprising:

a link mechanism configured to raise and lower the base lifting member.

3. The loading mechanism according to claim 2, wherein the link mechanism includes a plurality of link members; and at least one link member of the plurality of link members includes rotating members configured to be in contact with another link member of the plurality of link members.

4. The loading mechanism according to claim 3, wherein the base lifting member is connected to the at least one link member of the link mechanism through the rotating members.

5. The loading mechanism according to claim 2, further comprising:

pressing members configured to press connecting portions of the base lifting member against connected portions of the link mechanism.

6. The loading mechanism according to claim 1, wherein the base lifting member is configured to lower from the raised position to the lowered position by at least one of a self-weight of the base lifting member, the first movable base, or the second movable base.

7. The loading 1 mechanism according to claim 6, further comprising:

a base supporting member configured to support the second movable base, wherein a center of gravity of the second movable base is located at a more downstream side in the conveying direction than a second movable base supporting position at which the second movable base is supported by the base supporting member.

8. The loading mechanism according to claim 7, wherein the second movable base has a plurality of slots at a more upstream side in the conveying direction than the second movable base supporting position at which the second movable base is supported by the base supporting member.

9. The loading mechanism according to claim 7, further comprising:

a weight member on the second movable base at a more downstream side in the conveying direction than the second movable base supporting position at which the second movable base is supported by the base supporting member.

10. The loading mechanism according to claim 7, further comprising:

a preloading member configured to preload the second movable base upward at a more upstream side in the conveying direction than the second movable base supporting position at which the second movable base is supported by the base supporting member.

11. The loading mechanism according to claim 7, wherein the base supporting member includes contact portions in contact with the second movable base; and the contact portions are rotating members.

12. The loading mechanism according to claim 1, wherein the base lifting member is located at a center in the conveying direction of the bundle of objects loaded on the base lifting member, or is located at a more downstream side than the center in the conveying direction of the bundle of objects loaded on the base lifting member.

13. The loading mechanism according to claim 1, further comprising:

a slope member on a downstream end in the conveying direction of the first movable base, wherein the slope member is inclined with respect to a loading surface of the first movable base on which the bundle of objects is loaded.

14. A feeding device comprising:

a loading mechanism configured to load a bundle of objects to be conveyed, the loading mechanism is installed on a lifting member;

a conveying mechanism configured to convey an uppermost object from among the bundle of objects loaded on the loading mechanism; and an end fence configured to be movable in the conveying direction, the end fence being further configured to abut against a rear end in the conveying direction of the bundle of objects to restrict a position of the rear end in a conveying direction of the bundle of objects, wherein the loading mechanism includes, a first movable base on which a downstream side in the conveying direction of the bundle of objects to be conveyed is loaded, the first movable base being rotatable;

a second movable base on which an upstream side in the conveying direction of the bundle of objects is loaded, the second movable base being rotatable and on a more upstream side in the conveying direction than the first movable base; and a supporting member configured to, rotatably support an upstream end in the conveying direction of the first movable base, and rotatably support a downstream end in the conveying direction of the second movable base, wherein the supporting member is a base lifting member configured to raise and lower the upstream end of the first movable base and the downstream end of the second movable base, the first movable base and the second movable base are configured to rotate in accordance with a raising and a lowering of the base lifting member, in response to the lifting member bring at a lowered position, the base lifting member is further configured to be at a raised position, and the base lifting member is further configured to be lowered as the lifting member rises.

15. An image forming apparatus comprising:

the feeding device according to claim 14, the feeding device configured to feed an object to be conveyed; and an image forming apparatus configured to form an image on the object conveyed from the feeding device.

16. An image forming system comprising:

a feeding device configured to feed an object to be conveyed; and an image forming apparatus including at least an image forming apparatus configured to form an image on the object conveyed from the feeding device, wherein the feeding device includes, a first movable base on which a downstream side in a conveying direction of a bundle of objects to be conveyed is loaded, the first movable base being rotatable;

a second movable base on which an upstream side in the conveying direction of the bundle of objects is loaded, the second movable base being rotatable and on a more upstream side in the conveying direction than the first movable base; and a supporting member configured to, rotatably support an upstream end in the conveying direction of the first movable base, and rotatably support a downstream end in the conveying direction of the movable base, wherein the supporting member is a base lifting member configured to raise and lower the upstream end of the first movable base and the downstream end of the second movable base, the first movable base and the second movable base are configured to rotate in accordance with a raising and a lowering of the base lifting member, in response to the lifting member bring at a lowered position, the base lifting member is further configured to be at a raised position, and the base lifting member is further configured to be lowered as the lifting member rises.

17. The image forming system according to claim 16, further comprising:

a link mechanism configured to raise and lower the base lifting member.

18. The image forming system according to claim 17, wherein the link mechanism includes a plurality of link members; and at least one link member of the plurality of link members includes rotating members configured to be in contact with another link member of the plurality of link members.

19. The image forming system according to claim 18, wherein the base lifting member is connected to the at least one link member of the link mechanism through the rotating members.

20. The image forming system according to claim 17, further comprising:

pressing members configured to press connecting portions of the base lifting member against connected portions of the link mechanism.

* * * * *